US006213706B1

(12) United States Patent
Christenson

(10) Patent No.: US 6,213,706 B1
(45) Date of Patent: Apr. 10, 2001

(54) CLAMSHELL BASKET LOADER

(75) Inventor: Ronald E. Christenson, Parsons, TN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 09/312,534

(22) Filed: May 24, 1999

Related U.S. Application Data

(62) Division of application No. 09/063,761, filed on Apr. 21, 1998, now Pat. No. 5,934,858, which is a division of application No. 08/579,748, filed on Dec. 28, 1995, now Pat. No. 5,775,867.

(51) Int. Cl.[7] ..... B65F 3/04
(52) U.S. Cl. ..... 414/408; 414/555; 414/736
(58) Field of Search ..... 414/406–409, 414/487, 547, 549, 550, 555, 624, 695.5, 732, 736, 739; 294/2, 3, 68.23, 68.26

(56) References Cited

U.S. PATENT DOCUMENTS

| | | | | |
|---|---|---|---|---|
| 2,926,796 | * | 3/1960 | Martinson | 414/555 X |
| 3,080,988 | * | 3/1963 | Redman | 294/68.23 X |
| 3,427,640 | | 2/1969 | Clatterbuck . | |
| 3,762,586 | * | 10/1973 | Updike, Jr. | 414/408 |
| 3,796,331 | * | 3/1974 | Dutton | 414/550 X |
| 3,910,434 | | 10/1975 | Ebeling et al. . | |
| 3,954,194 | * | 5/1976 | Stedman | 414/555 X |
| 4,090,626 | | 5/1978 | Ebeling et al. . | |
| 4,175,903 | | 11/1979 | Carson . | |
| 4,367,891 | | 1/1983 | Wauer et al. . | |
| 4,425,070 | | 1/1984 | Howells et al. . | |
| 4,427,333 | | 1/1984 | Ebeling . | |
| 4,597,710 | | 7/1986 | Kovats . | |
| 4,726,726 | * | 2/1988 | Dossena et al. | 414/408 |
| 4,840,531 | | 6/1989 | Dinneen . | |
| 4,978,271 | | 12/1990 | Seader . | |
| 5,007,786 | | 4/1991 | Bingman . | |
| 5,035,563 | | 7/1991 | Mezey . | |
| 5,122,025 | | 6/1992 | Glomski . | |
| 5,288,196 | | 2/1994 | Horning et al. . | |
| 5,316,430 | | 5/1994 | Horning et al. . | |
| 5,330,308 | | 7/1994 | Armando et al. . | |
| 5,391,039 | * | 2/1995 | Holtom | 414/408 |
| 5,427,496 | | 6/1995 | Ratledge, Jr. et al. . | |
| 5,577,877 | | 11/1996 | Smith et al. . | |
| 5,769,594 | * | 6/1998 | Kalua | 414/408 X |

FOREIGN PATENT DOCUMENTS 0243183 10/1965 (AT) .

* cited by examiner

*Primary Examiner*—James W. Keenan
(74) *Attorney, Agent, or Firm*—Nikolai, Mersereau & Dietz, P.A.

(57) ABSTRACT

A loading device mounted to a collection vehicle is disclosed. The loading device may comprise several embodiments for scooping a soft-sided object through either a horizontal or vertical plane. The loading device is attached to a mechanized arm for compound angular displacement and operable between a stowed, extended, lift, and dump positions. A swivel mount interconnects the mechanized arm to the collection vehicle and further compounds the angular displacement and operating positions of the loading device.

12 Claims, 45 Drawing Sheets

CLAMSHELL BASKET LOADER

RELATED APPLICATIONS

This application is a division of application Ser. No. 09/063,761, filed Apr. 21, 1998, now U.S. Pat. No. 5,934,858, issued Aug. 19,1999, which itself is a division of Ser. No. 08/579,748, filed Dec. 28, 1995, now U.S. Pat. No. 5,775,867, issued Jul. 7, 1998.

BACKGROUND OF THE INVENTION

1. Field of the Invention

This invention relates generally to mechanized material handling devices. More particularly, this invention relates to an apparatus for scooping, lifting and dumping objects, either hard or soft-sided, into a fixed or removable collection receptacle.

2. Discussion of the Related Art

Over the years, the labor intensive collection of waste and recyclable materials has become increasingly automated. To further automate the collection process, considerable changes and advancements have been made to the vehicles used to collect, haul, and dispose of waste and recyclable materials. To this end, collection vehicle types have been developed that load from the back, front, or side.

Furthermore, the types of containers in which materials are placed at the points of collection have evolved into various designs to assist in collection automation. For example, the containers may be large rigid steel enclosures, rigid plastic cans, removable collection receptacles, or one use throw away receptacles. The existence of many types of containers, of course, has led to the development of a variety of dedicated accessing, lifting and dumping devices carried by collection vehicles.

Recognition of the need to automate the collection of waste materials, has led to the development of mechanized handling devices including container holding or grasping devices. These grasping devices are commonly connected to an arm which is connected to a base, such as a collection vehicle. The arm and grasping device are operated to engage, lift and dump a container of interest into a receiving hopper of the collection vehicle.

Many current grasping devices attempt to simulate the movement and grasping of the opposed thumb and forefinger of a primate. Opposing members of a typical grasping device are drawn together toward a central plane. In use, the opposing members surround a container and pinch the container with enough force so that the container does not slip through the opposing members.

A representative example of such a grasping device appears in U.S. Pat. No. 5,391,039, issued to Holtom, which describes a refuse loader arm that includes a lift member and a reach member articulated to one another at a pivot point. The lift member pivots vertically and is attached at one end to the refuse vehicle. The reach member is further articulated at its free end to a pair of finger like members which are held at a constant angle to the lift member by a parallelogram linkage. The lift member and the reach member pivot in a common plane to reach out and grasp the container of interest and lift and dump the container.

Similarly, U.S. Pat. No. 4,175,903, issued to Carson, describes an apparatus for picking up containers wherein a boom arm is attached to a platform. The platform is pivotally attached to a refuse vehicle for rotating in a generally horizontal plane, and the boom arm is pivotally attached to the platform for pivoting vertically to raise and dump a container. Two pick-up arms, in relatively parallel spaced relation and attached to the boom arm, are provided to squeeze the container.

Examples of other grasping devices including a single actuator and a pair of arcuate arms are described in U.S. Pat. No. 4,461,608, to Boda; U.S. Pat. No. 4,708,570, to Smith et al.; and U.S. Pat. No. 5,026,104, to Pickrell. Each of the devices described in these patents includes a relatively complex linkage mechanism not designed to grasp soft sided containers such as plastic bags. Boda describes an apparatus including a pair of arcuate arms connected to a common support member at spaced pivot joints. A shaft is connected to each arm and to a lever arm, wherein movement of the lever arm by an actuator causes the shaft to rotate to move the gripping arms. Smith et al. describe a grasping device including a single actuator pivotally connected to an arcuate arm and a connecting rod attached to this arm to operate a second arcuate arm to grasp an object of interest. Pickrell describes a gripping device having a single actuator attached to a lever which, in turn, is attached to rotate an arcuate arm having gears meshed with gears operating a second arcuate arm. The arms carry a belt or flexible mechanism to enclose and grab circular objects of various sizes. In each of these systems a relatively complex linkage mechanism is required to move the arms.

Grasping devices which include multiple actuators and a pair of single member arcuate arms have been described in U.S. Reissue Pat. No. 34,292, and U.S. Pat. Nos. 4,227,849 and 4,872,801. In each of these patents, the arms are pivotally attached to a common support member and operated by hydraulic cylinders pivotally attached to the same support member.

A grasping device including multiple actuators and arms having multiple members is described in U.S. Pat. No. 4,669,940, issued to Englehardt et al. That device provides a pair of straight secondary arms pivoted to a common support member inside a pair of angled primary arms. The secondary arms roll along the inside of the primary arms to form a hexagon as the primary arms are pushed together by hydraulic cylinders.

U.S. Pat. No. 5,092,731, issued to Jones et al, describes a grasping device including two compound (segmented) arcuate arms linked to an I-beam member operated by actuators. The inner portion or segment member of each arm is slidably attached to the I-beam member which, in turn, is pivotally attached to the common support member. The I-beams rotate to move the inner members between an open and a closed position as the actuating hydraulic cylinders retract and expand, respectively. The outer portions or segment members of each arm are pivotally attached to the inner member and rollers at the end of each I-beam cause the outer members to rotate about the pivot joint to grasp an object.

The devices discussed above are designed to grasp generally circular, relatively rigid objects. A device for lifting and holding containers having a plurality of basic rigid shapes is described in U.S. Pat. No. 4,401,407, to Breckenridge. Breckenridge describes a device having a pair of arms including an inner member pivoted at one end to a frame and an outer member pivoted between its ends to the second end of the inner member. A complex linkage mechanism is attached between the frame and the two members for coordinating movement of the inner and outer members. While the mechanism is functional, this device also does not effectively grasp plastic bags or other soft sided containers.

PCT International Application Publication No. WO 92/01612 describes a device for grasping containers of several rigid shapes. The described device includes oppositely disposed compound articulated arms pivotally attached to a central support member. Each arm includes an inner and an outer member curved to fit around a container and having grip padding for holding the container. In operation, the arms are moved by four actuators. Although gripping pads are provided, a soft sided container would slip through the articulated arms.

Other refuse collection systems have included grasping and loading systems. Side-loading mechanisms of this type are described in U.S. Pat. Nos. 3,910,434 and 4,090,626 to Ebeling et al.; U.S. Pat. No. 4,427,333 to Ebeling; and U.S. Pat. No. 4,597,710 to Kovats. A vertical rail assembly having a bin-gripping carriage apparatus for engaging, lifting and dumping a refuse container is the subject of U.S. Pat. No. 5,007,786 to Bingman.

Loading devices having dedicated multi-compartment collection receptacles which operate using guided mechanized lift and dump systems to lift and empty containers into corresponding receptacles have also been described. One such system is shown in Dinneen (U.S. Pat. No. 4,840,531). The internal compartments are discharged by tilting the truck body relative to the chassis. In Seader (U.S. Pat. No. 4,978,271), an enclosed bucket having an open top is mounted on each side of the truck's chassis, forward of a rear-loading refuse body, wherein the buckets are emptied into larger side loading compartments. Mezey (U.S. Pat. No. 5,035,563) discloses multi-compartment container/hopper systems for front and side-loading trucks.

A further side-loading multi-compartment system is depicted by Ratledge, Jr., et al. in U.S. Pat. No. 5,427,496. Other partitioned side bucket manually loaded multicompartment refuse truck bodies are illustrated and described by Horning et al. in U.S. Pat. Nos. 5,288,196 and 5,316,430 and by Glomski in U.S. Pat. No. 5,122,025. Howells et al. (U.S. Pat. No. 4,425,070) discloses a single sided partitioned bucket which loads compartments forward of a rear-loading refuse body mounted on an elongated frame. Although these systems incorporate grasping mechanisms, none of these grasping devices are able to mechanically scoop a soft sided container or scoop and grasp a hard sided container.

As is evident from the above discussion, a rather large number of grasping, gripping, and lift/dump mechanisms have been devised which take many forms and levels of complexity. Individually, however, these devices generally lack the versatility required to address a typical mixed container load presented by a household or the like which may consist of a variety of containers of fixed shape and soft containers such as refuse bags and possibly other debris. The present invention contemplates an improved more versatile container grasping and emptying or loading system that combines many desired attributes. The system can be used to load single or multi-compartment collection receptacle. The container handling system emptying device is equipped to scoop or grab both hard sided and soft disposable containers, such as refuse bags, either separately or in combination. The present invention also simplifies the mechanical complexity of prior grasping systems and introduces improvements which facilitate efficient operation.

It is accordingly a principal object of the present invention to provide a mechanically simplified device for handling objects of various shapes and rigidities.

Another object of the invention is to provide a mechanically simplified scooping and grasping device that includes actuators for scooping or grasping objects of various shapes, sizes and rigidities.

Still another object of the invention is to provide a mechanically simplified scooping device that pivots in both a generally horizontal or generally vertical plane.

A further object of the invention is to provide a simplified scooping device associated with a multi-compartment collection vehicle having a divided charging hopper.

Other objects, features, and advantages of the present invention will become apparent to those skilled in the art through familiarity with the summary of the invention, detailed description, claims, and drawings herein.

SUMMARY OF THE INVENTION

The foregoing objects of the present invention are attained by providing a scooping device capable of grasping, lifting and dumping soft sided containers. The scooping device includes a pair of opposed, hinged, mechanized jaws or scoops that are pivotally connected to a support member or support arm. In one embodiment, the scoops are stowed in an open position, and close when actuated, each scoop pivoting in a predetermined plane towards the other in the fashion of a clamshell. The scoops intersect in a relatively vertical plane forming a relatively continuous basket structure. The scoops have opposed open sides, or recesses, such that containers grasped into the closed scoops may be dumped out of the opening formed by the combined scoops.

The scoop combination or clamshell may be used effectively to pick up and dump a variety of containers including plastic or paper bags. For ease of discussion, without any limitation intended, reference will be made to the collection of plastic bags containing leaves for recycling. Typically, leaf bags are left at curbside for collection. Known grabber devices either damage the bags in attempting to grasp them, or are unable to grab bags at all. The scooping device, often, is aligned next to the bag, and each scoop is actuated to the closed position, thereby scooping and capturing the bag in the clamshell formed by the scoops. The scoops may pivot and actuate closed in either a generally horizontal, vertical, or any other plane.

In an alternate embodiment, a grabbing device and a scooping device are mounted in combination to a support member. The grabbing device has a pair of spaced, opposed arms pivotally connected to the support member. The scooping device pivots and actuates closed in a generally horizontal plane directly below the grabbing device. The grabbing device and scooping device may be operated independently or in unison.

The support member of the grasping and/or scooping devices may be mounted to any compatible apparatus. For example, it may be mounted on a material handling truck, such as a forklift, or a mechanical swivel arm attached to a refuse truck for grasping, lifting, dumping (tipping) and replacing refuse containers, as it is in the examples of the detailed embodiments. In the latter situation, the mechanical swivel arm may be manipulated to position the scoop or grabbing device around a container of interest. Either the scoop, grabber or both are then closed to grasp the container. The mechanical swivel arm is manipulated to lift and tip the container. A container addressed by the scoop typically only is dumped intact into the collection receptacle. The grabber may be used in conjunction with the scoop to hold a container within the scoop as the contents are dumped from the container.

The articulated mechanical swivel arm is attached, for example, to the chassis of a refuse vehicle, and includes arm members joined or articulated to one another, at one end. The first arm member (the lift member) is pivotally attached at a second end to an arm pivot support attached to the chassis and the second arm member (the reach member) has a free end which attaches to the support member of the scoop and grabber devices. The articulated arm pivots in a generally vertical plane to provide a lift and dump function.

In operation, at the beginning of a lift and dump cycle, the pair of scoops and the digits of the grabber are in "stowed" or open position and the articulated arm is fully retracted. From this position, the articulated arm is extended to move the scoop and grabber toward the container of interest. The scoop, grabber or both, as selected, are operated to a closed position to grab the container. The articulated arm is operated generally vertically to lift and tip or invert the container and empty the contents into a receiving hopper of the vehicle.

In another embodiment, a grabber device is provided with a pair of swivel mounted scoops pivotally attached directly to spaced apart opposing grabber arms. The scoops pivot downward and inward relative to the opposing grabber arms through a vertical plane, thereby scooping under and providing bottom support to the container being picked up by the grabber arms. In this manner, the grabber arms and scoops work together to both grab and scoop a desired object.

One grabbing device suitable for use with the scoop devices has a pair of spaced, opposed arms or digits pivotally connected to the support member. The arms are shaped to fit around containers of a plurality of different shapes, including curved, rectangular, hexagonal and others. The arms are pivoted between an open or retracted position and a closed or grasping position by fluid-operated actuators, such as hydraulic cylinders.

The arms may be either single or plural member type arms having curvilinear shape and in one embodiment shown, the plural member or articulated dual arm embodiment is described in which each arm has an inner member pivotally connected at one end to a common support member and an outer member pivotally connected to a corresponding inner member. The fluid-operated actuators, such as double acting hydraulic cylinders, are pivotally connected between each outer member and the common support member. The pivot points of the arms are closer together and closer to the container of interest than those of the actuators on the common support to provide leverage and allow the arms to grasp the container of interest on the power stroke of the double acting hydraulic cylinders.

The present invention represents a variety of improvements in a class of loading devices which can take the form in any of a great variety of embodiments. The detailed embodiments are taken as representative or exemplary of those in which the improvements of the invention may be incorporated and are not presented as being limiting in any manner.

DETAILED DESCRIPTION

Figure 1:
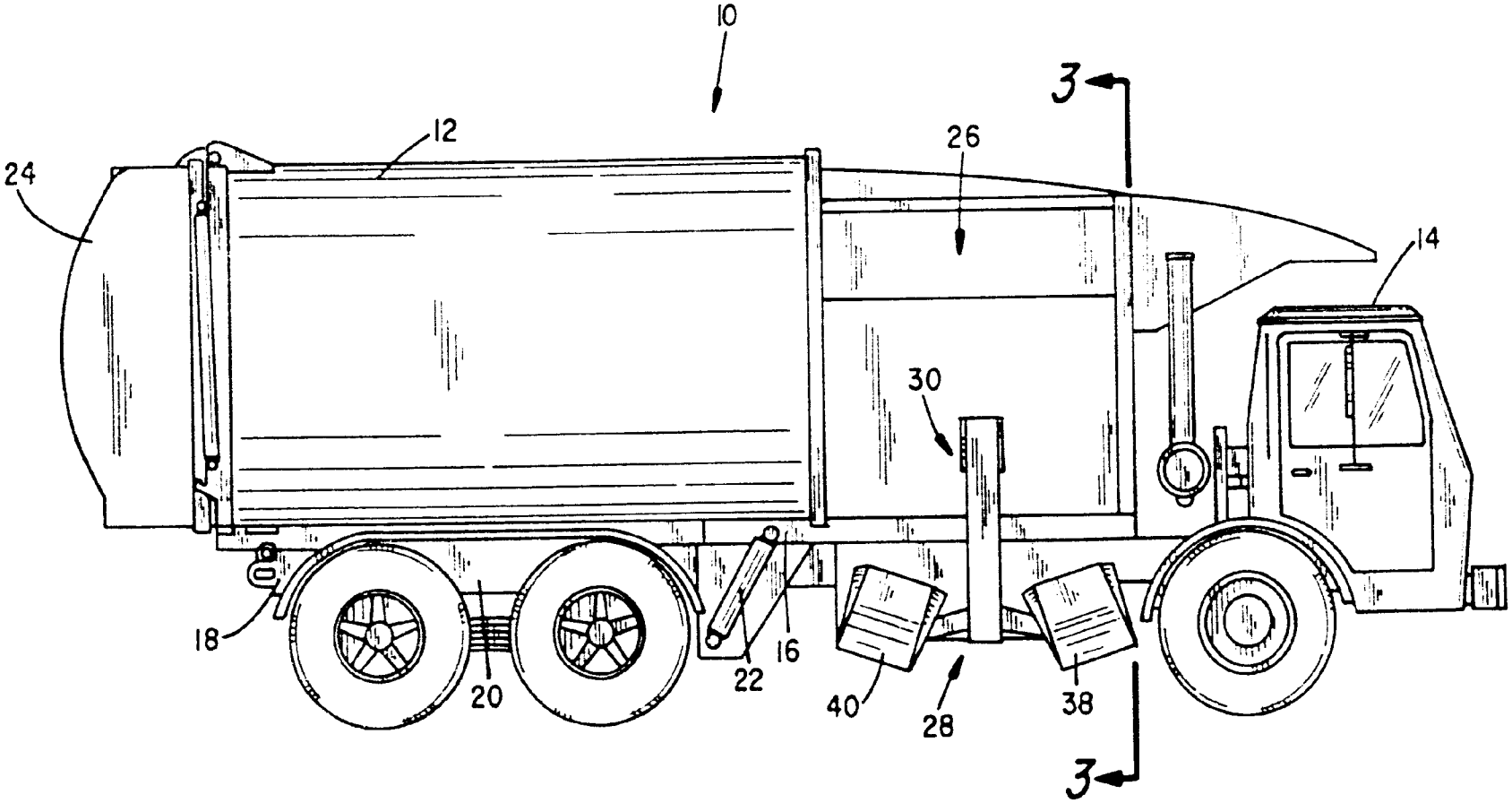
FIG. 1 is a side elevational view of a side loading refuse vehicle including one embodiment of the invention, shown with the loading device and mechanized arm in their stowed positions.
Figure 2:
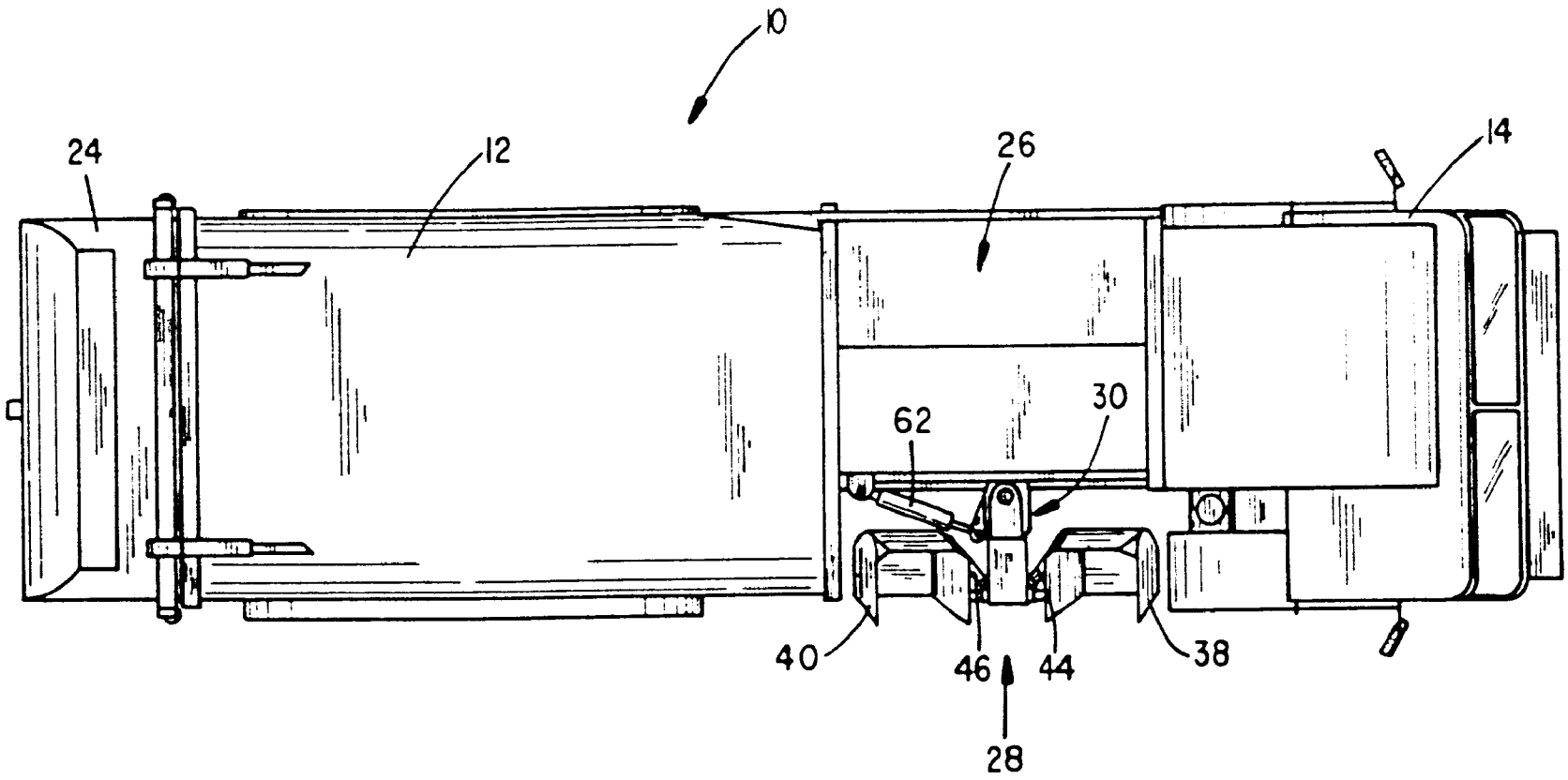
FIG. 2 is top plan view of the side loading refuse vehicle shown in FIG. 1.

In conjunction with the several views of the figures, details of representative embodiments will next be presented. Referring first to FIG. 1, there is shown a refuse collection vehicle generally at 10. The refuse collection vehicle 10 includes a refuse storage body 12 mounted on a refuse truck 14. Without limitation, the storage body 12 is mounted on a tilt frame 16 which in turn is pivotally connected at 18 to the truck frame 20. The tilt frame 16 is operated by a pair of tilting cylinders, one of which is shown at 22, which extend to lift the forward end of the storage body 12 and charging hopper 26 during a dumping cycle. The storage body 12 is provided with a top-hinged tailgate 24, against which material can be compacted and whereby material stored in the storage body 12 may be discharged in a well known manner.

The refuse storage body 12 and charging hopper 26 are recessed to allow compact storage of a side mounted loading device 28. The loading device generally identified by numeral 28 may take on any of several embodiments, some of which are discussed below. Those skilled in the art will recognize that the storage body 12, tailgate 24 and charging hopper 26 all may be designed for multi-compartment charging and storage, the details of which are more fully disclosed in co-pending application Ser. No. 08/570,676, filed Dec. 11, 1995, now abandoned, and assigned to the same assigns as the present application, the entire disclosure of which is incorporated herein by reference.

Figure 3:
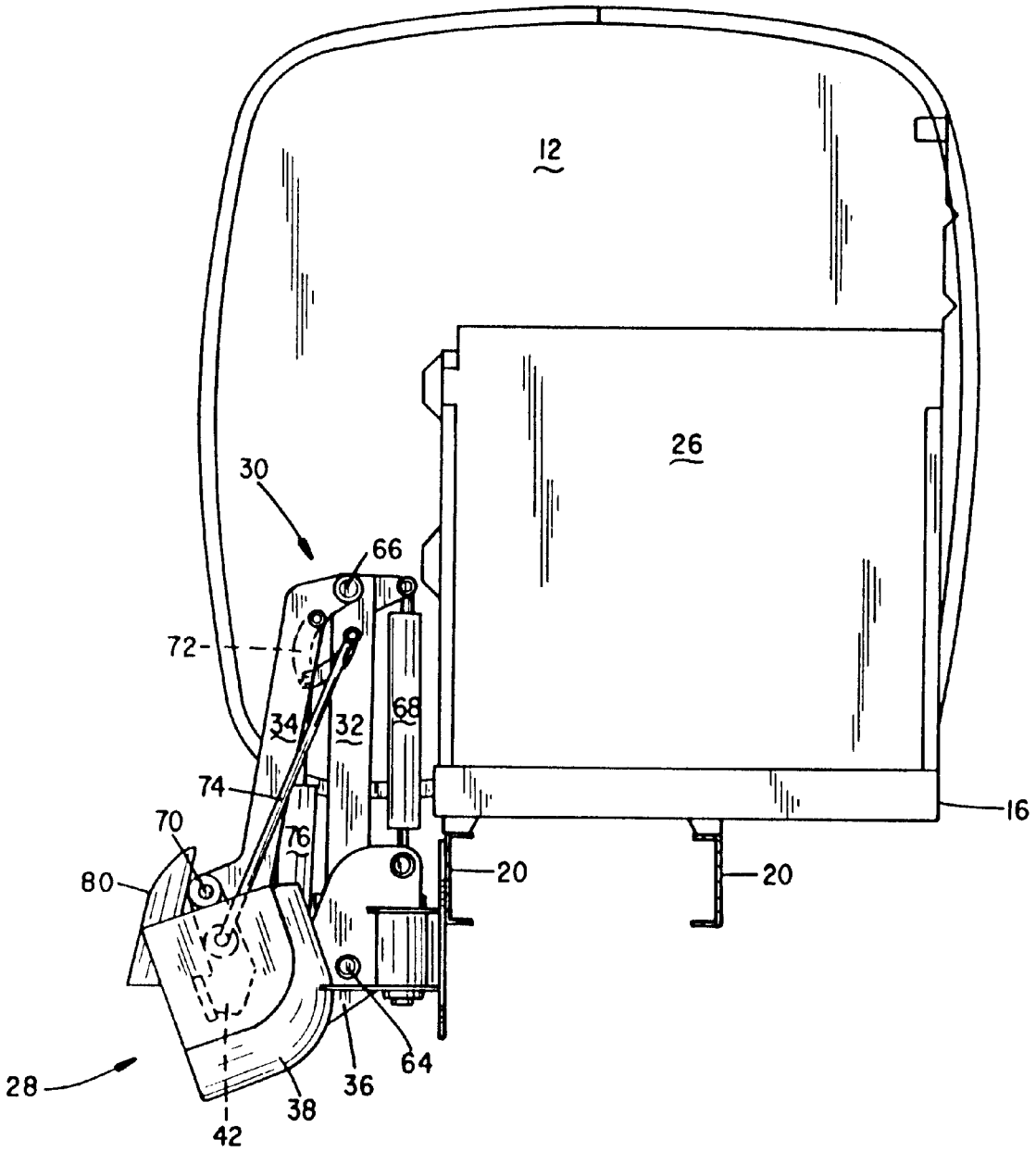
FIG. 3 is a cross-sectional view taken along line 3—3 of FIG. 1.

The loading device 28 of FIG. 1 is pivotally mounted to a mechanized arm 30. As best seen in FIG. 3, the mechanized arm includes a lift member 32 pivotally mounted to a reach member 34. The lift member 32 is attached to a swivel mount 36 which, in turn, is attached to the refuse truck frame 20. The reach member 34 is attached at one end to the lift member 32, and attached at the other end to a central support member 42. Those skilled in the art will recognize that the mechanized arm may consist of any of several embodiments known in the art including, but not limited to, a boom, an articulated mechanized arm, or an articulated swivel able arm. For ease of discussion an articulated mechanized arm will be referred to below.

In the embodiment shown in FIGS. 1–9, the loading device 28 is shown having a pair of scoops 38 and 40 aligned and pivotally connected to a central support member 42. Each scoop 38 and 40 is hingedly attached at 48 and 50 respectively, to the support member 42 and actuated closed by an associated hydraulic cylinder 44 and 46. The hydraulic cylinders 44 and 46 are attached to the support member at one end and each respective scoop 38 and 40 at the other end, to thereby actuate the scoops from an open first position to a second closed position. Each scoop 38 and 40 has an open front 52 and top 54, whereby, when each scoop 38 and 40 is actuated to a closed position, the two scoops 38 and 40 form a clamshell or bucket 56 having an open top (see FIGS. 7–10). Each scoop 38 and 40 is formed from a durable, rigid metal or polymer material the construction of which is known in the art. An internal portion of each scoop 58 and 60 is sloped to assist in the efficient loading and unloading of refuse from the clamshell 56 (see FIGS. 4 and 5).

Figure 4:
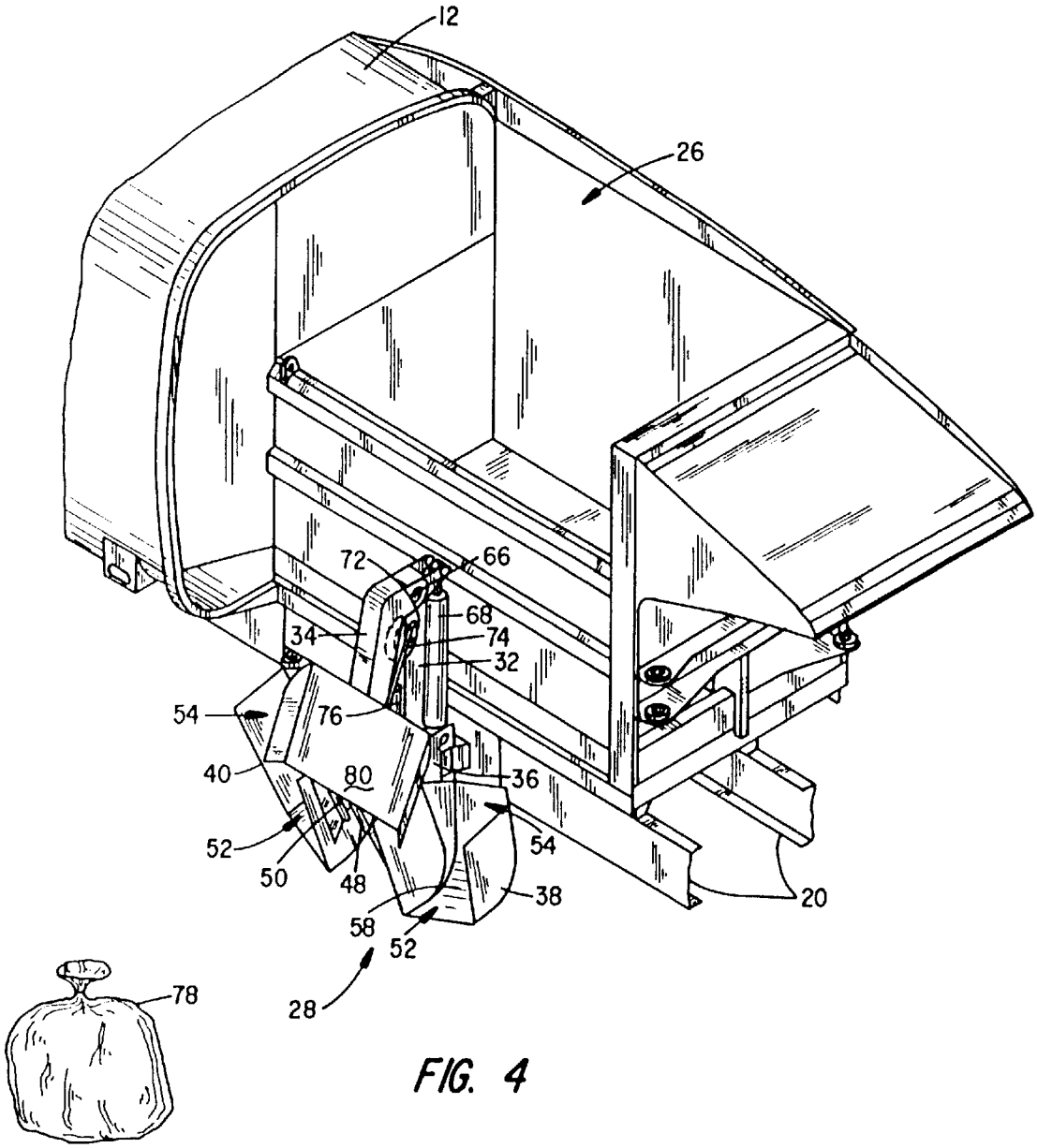
FIG. 4 is an enlarged fragmentary perspective view of the loading device shown in FIG. 1.
Figure 5:
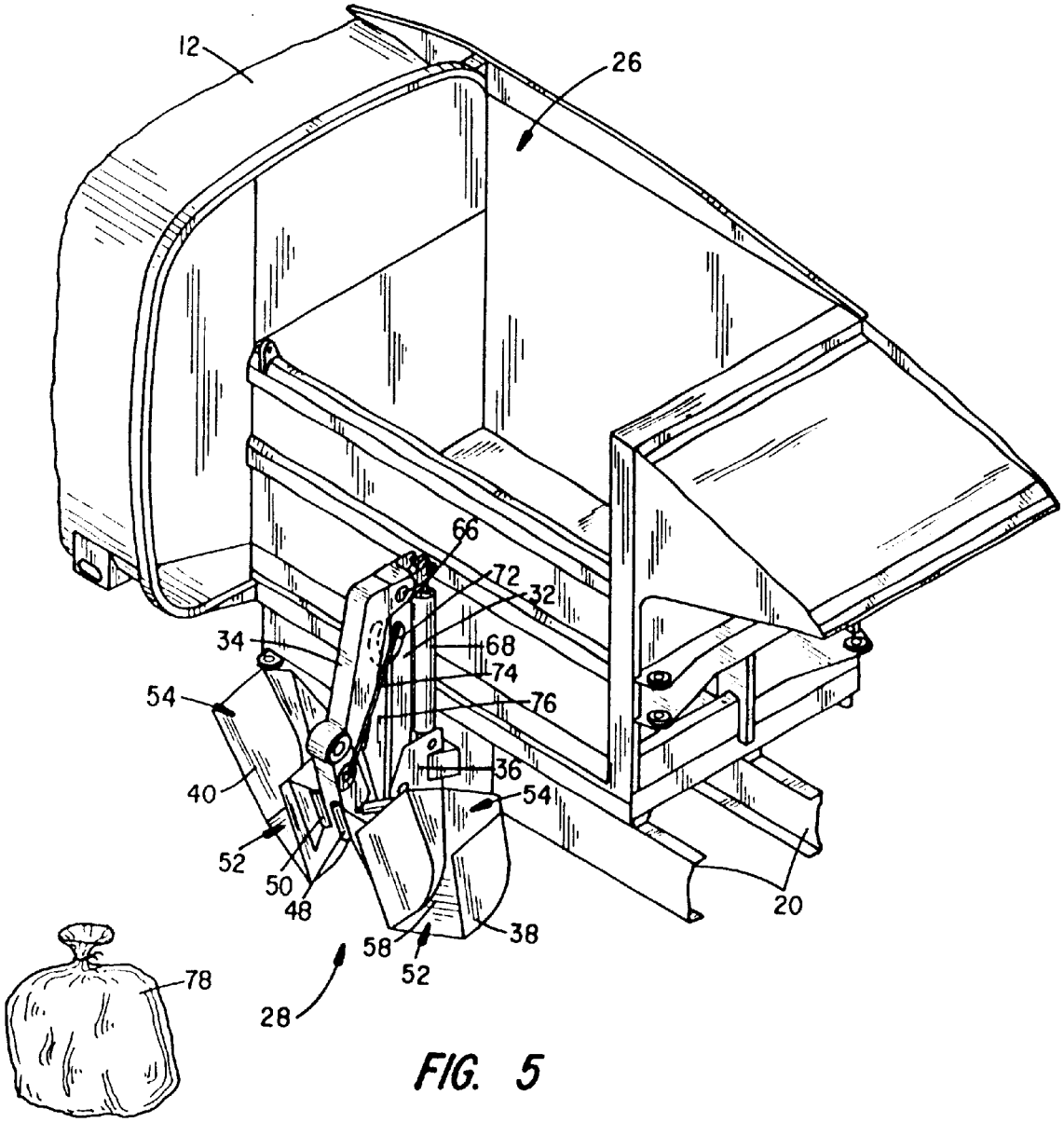
FIG. 5 is an enlarged fragmentary perspective view of the loading device shown in FIG. 1 with the deflector shield removed.

FIGS. 3–5 depicts the relation among the mechanized arm 30, swivel mount 36, and actuators. The swivel mount 36 is shown mounted to the chassis 20 of the refuse vehicle. The swivel mount 36 allows the mechanized arm 30 to be positioned anywhere between a first forward position, a middle stowed position and a third aft position. The swivel mount is operated as by hydraulic cylinder 62. The lower (inner) end of the lift member 32 is pivotally attached at 64 to the swivel mount 36, while the other end of the lift member 32 is pivotally attached at 66 to the reach member 34. A hydraulic cylinder 68 is attached at one end to the swivel mount 36 and attached at its other end to the upper end of the lift member 32. As the hydraulic cylinder 68 extends outward, the lift member 32 pivots outward and down, from a relatively vertical position, away from the charging hopper and truck body. When the hydraulic cylinder 68 retracts, the lift member 32 pivots inward and upward in a lifting direction toward the charging hopper and truck body.

The outer or free end of the reach member 34 is pivotally attached at 70 to the support member 42. A hinged linkage 72 is pivotally attached to both the lift and reach members 32 and 34 near the pivotal attachment 66 of the lift and reach members 32 and 34. One end of a hydraulic cylinder 76 is attached to the swivel mount 36 while the other end is attached to the hinged linkage 72. In this manner, when hydraulic cylinder 76 extends outward, the reach member 34 extends away from the lift member 32. A linkage rod 74 is attached at one end to hinged linkage 72 and the other end to the central pivot point of support member 42 (see FIG. 6). In this manner, even as reach limb 34 extends away from lift limb 32, the planar alignment of scoops 38 and 40 remains relatively fixed.

Figure 6:
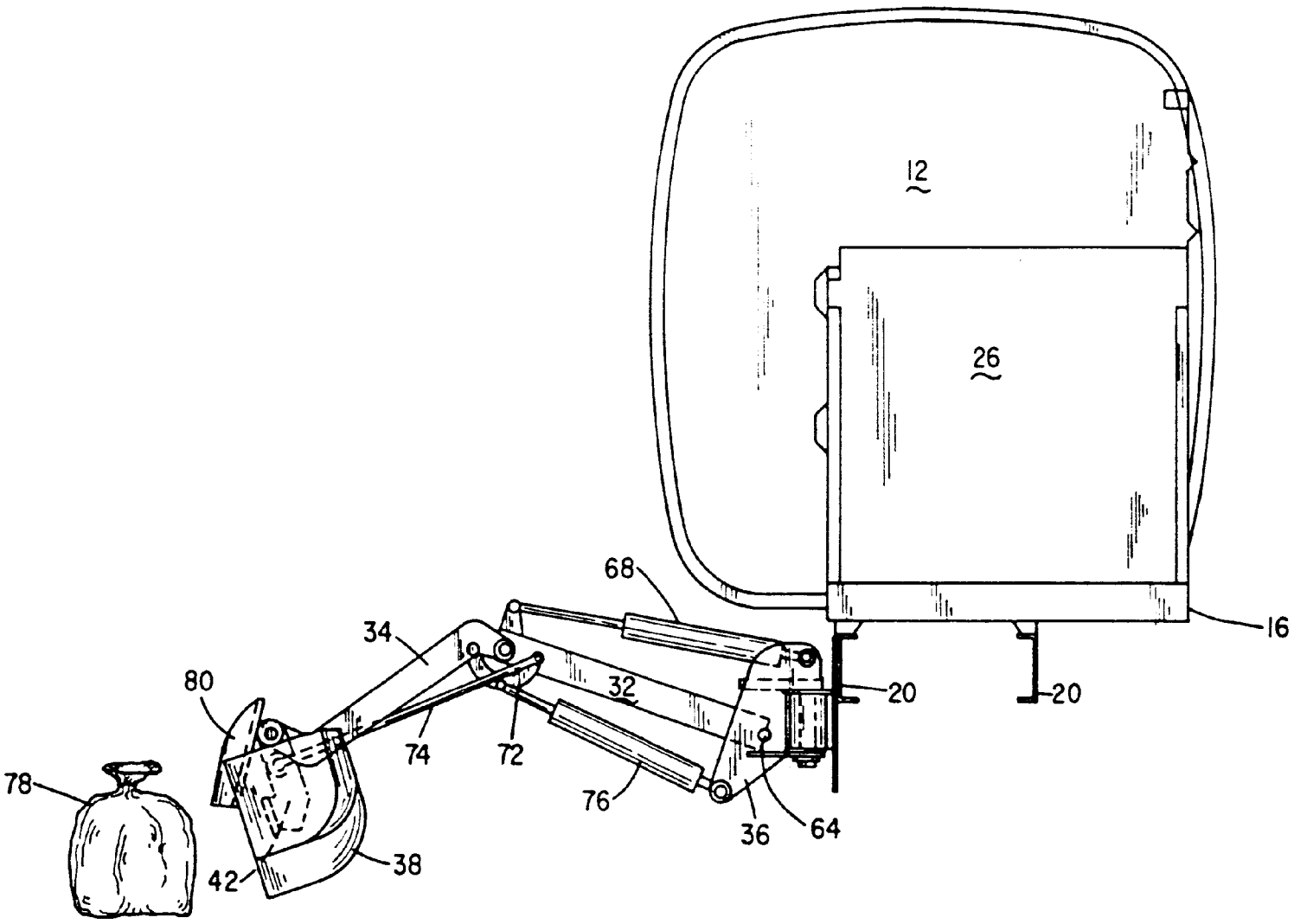
FIG. 6 is a front elevational view, partially in section, of the side loading refuse vehicle shown in FIG. 1, with the loading device extended.
Figure 7:
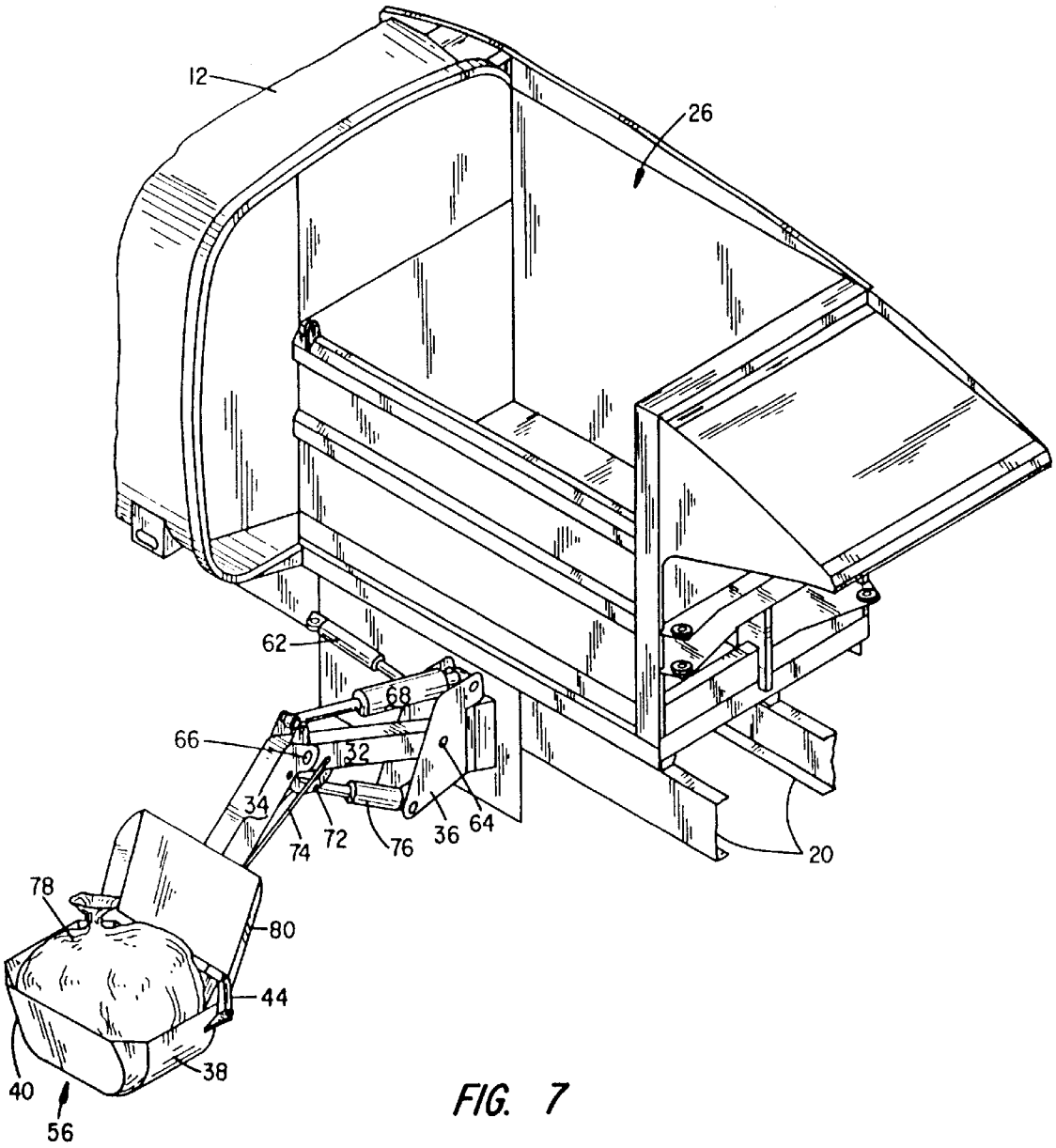
FIG. 7 is an enlarged fragmentary perspective view of the extended loading device shown scooping a soft-sided bag.
Figure 8:
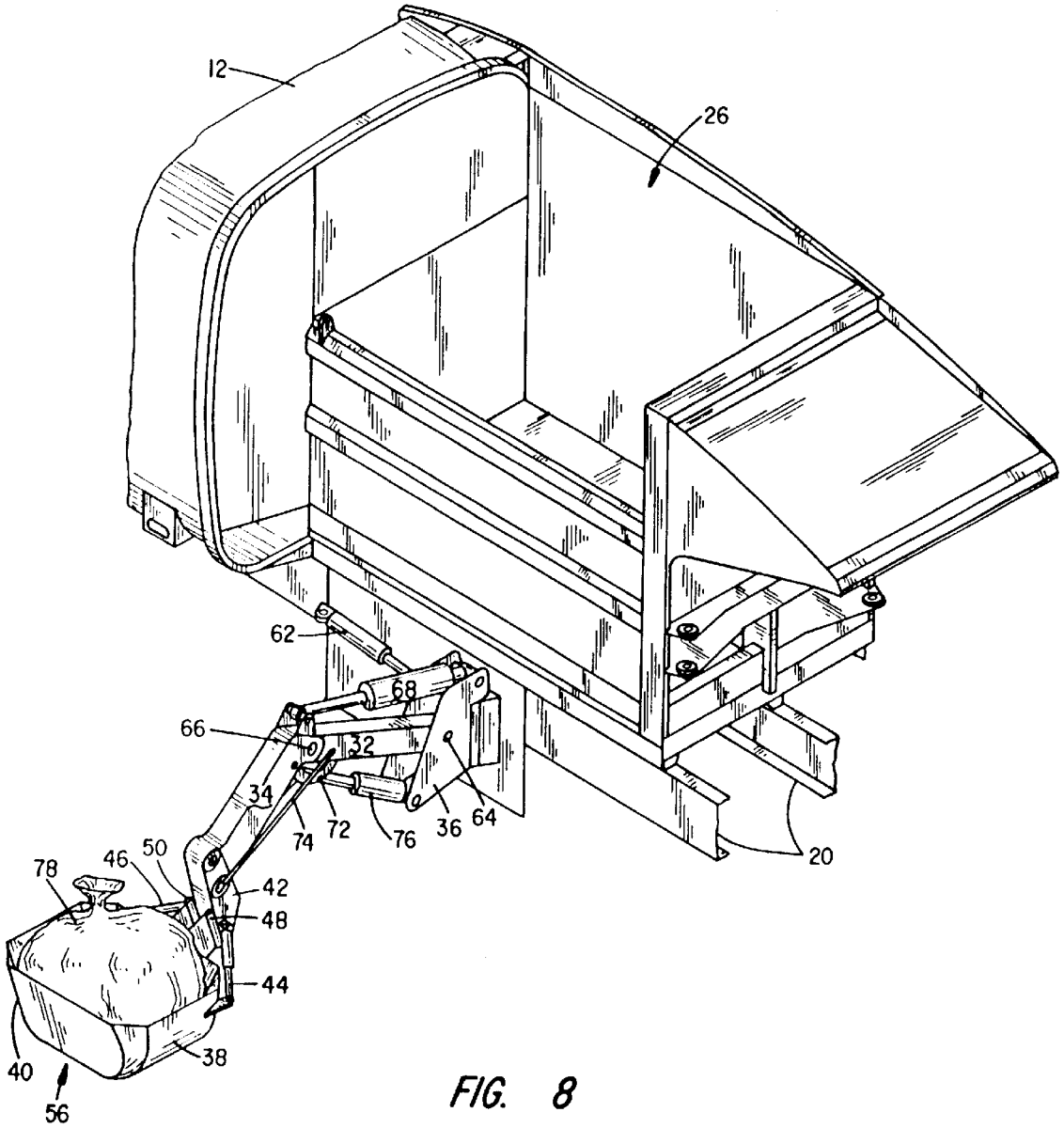
FIG. 8 is a view similar to that of FIG. 7 with the deflector shield removed.

In the series of FIGS. 5–10, various positions of the loading device 28 are shown. FIG. 5 shows the loading device 28 and mechanized arm 30 in their stowed position. FIG. 6 shows the reach member 34 and lift member 32 in an extended position while the scoops 38 and 40 remain in their stowed position. FIG. 7 shows the scoops 38 and 40 actuated to their closed position, having scooped under and enclosed a soft sided container 78. In FIG. 8, the deflector shield 80 is removed, thereby revealing certain details including the hydraulic cylinders 44 and 46 shown in their extended clamshell closing position.

Figure 9:
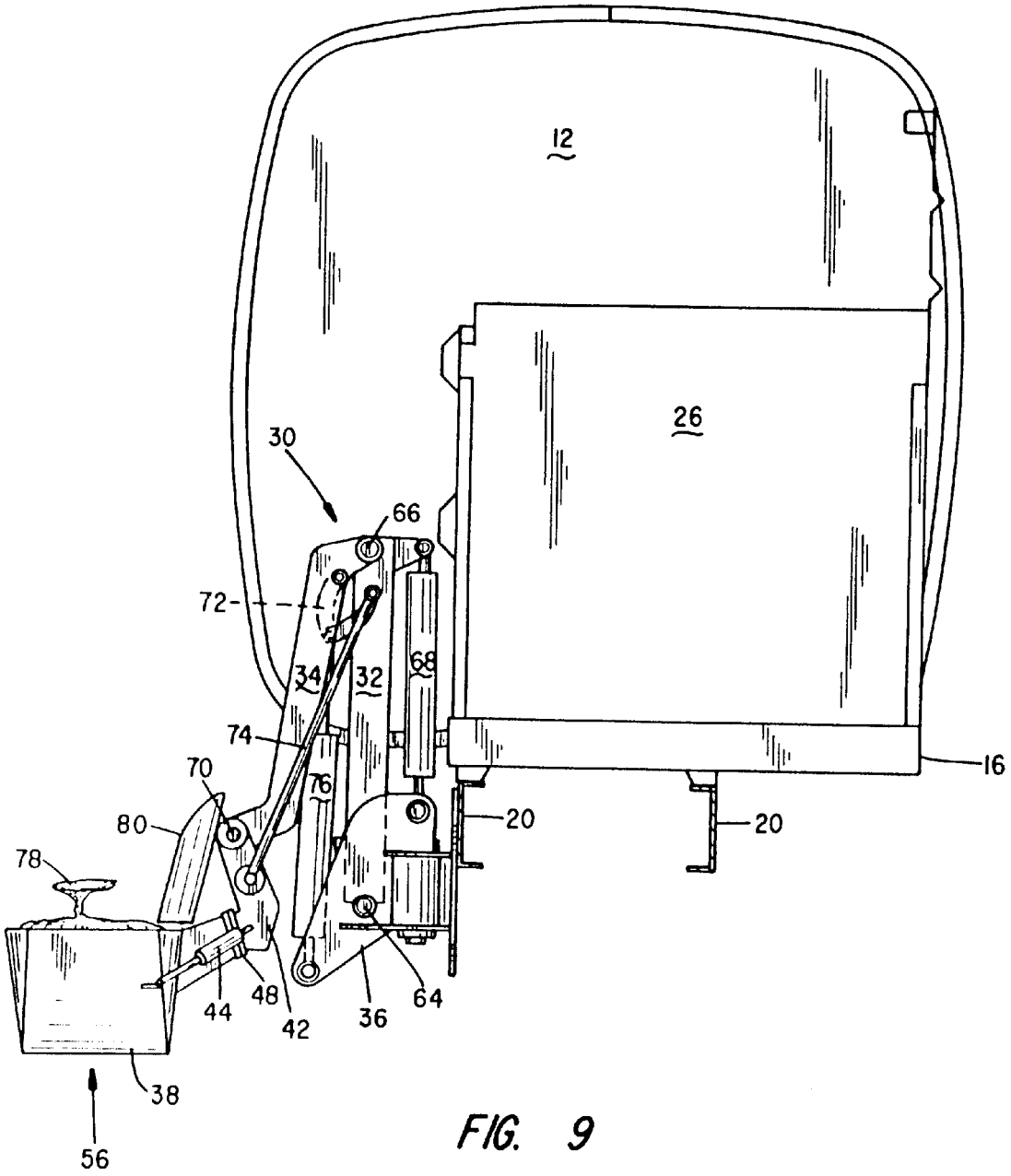
FIG. 9 is a front elevational view, partially in section, of the side loading refuse vehicle shown in FIG. 1, with a soft-sided bag captured within the clamshell.
Figure 10:
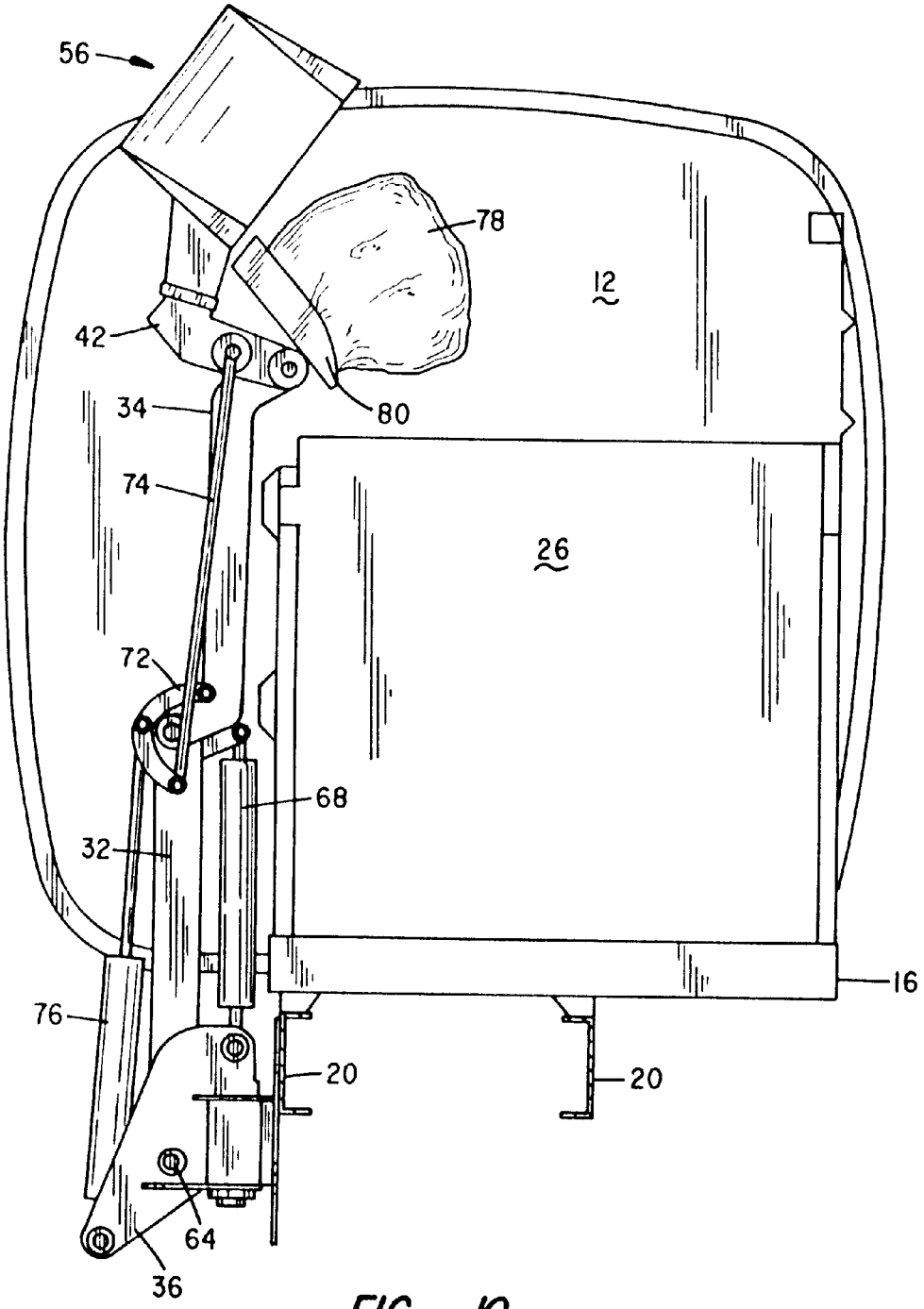
FIG. 10 is a front elevational view, partially in section, of the side loading refuse vehicle shown in FIG. 1, shown dumping the soft-sided bag into the hopper.

FIG. 9 shows the lift and reach members 32 and 34 in their retracted positions with scoops 38 and 40 closed about the soft sided container 78. FIG. 10 illustrates the dumping of container 78. The lift member 32 is in its vertical (stowed) position, while actuated cylinder 76 extends the reach member 34 to its fully pivoted and extended position. Those skilled in the art will recognize that the scoops 38 and 40 may need to be opened slightly to allow the container 78 to dump out of the formed clamshell.

Figure 11:
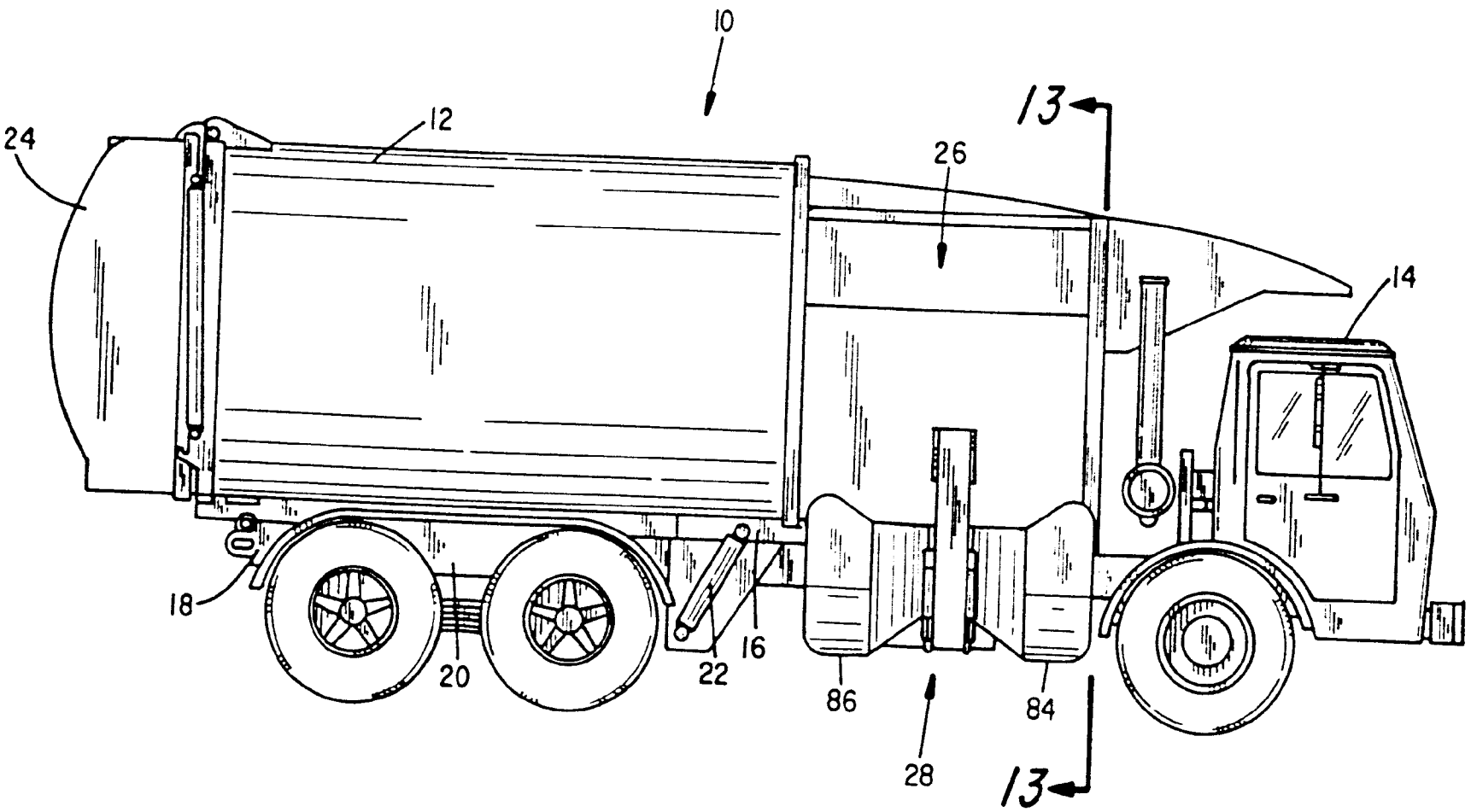
FIG. 11 is a side elevational view of a side loading refuse vehicle including an alternate embodiment of the invention, showing the loading device and mechanized arm in their stowed positions.
Figure 12:
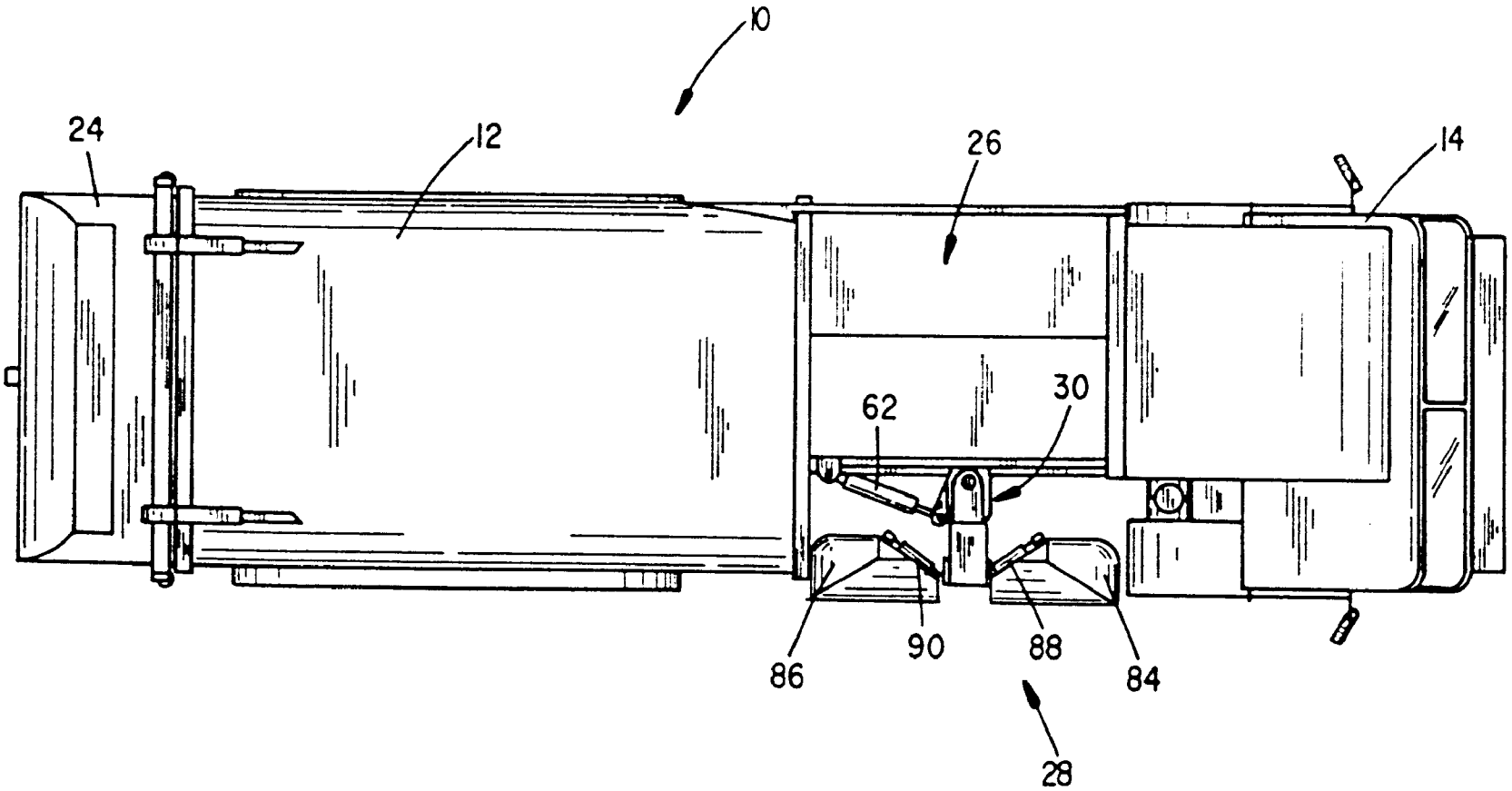
FIG. 12 is top plan view of the side loading refuse vehicle shown in FIG. 11.
Figure 13:
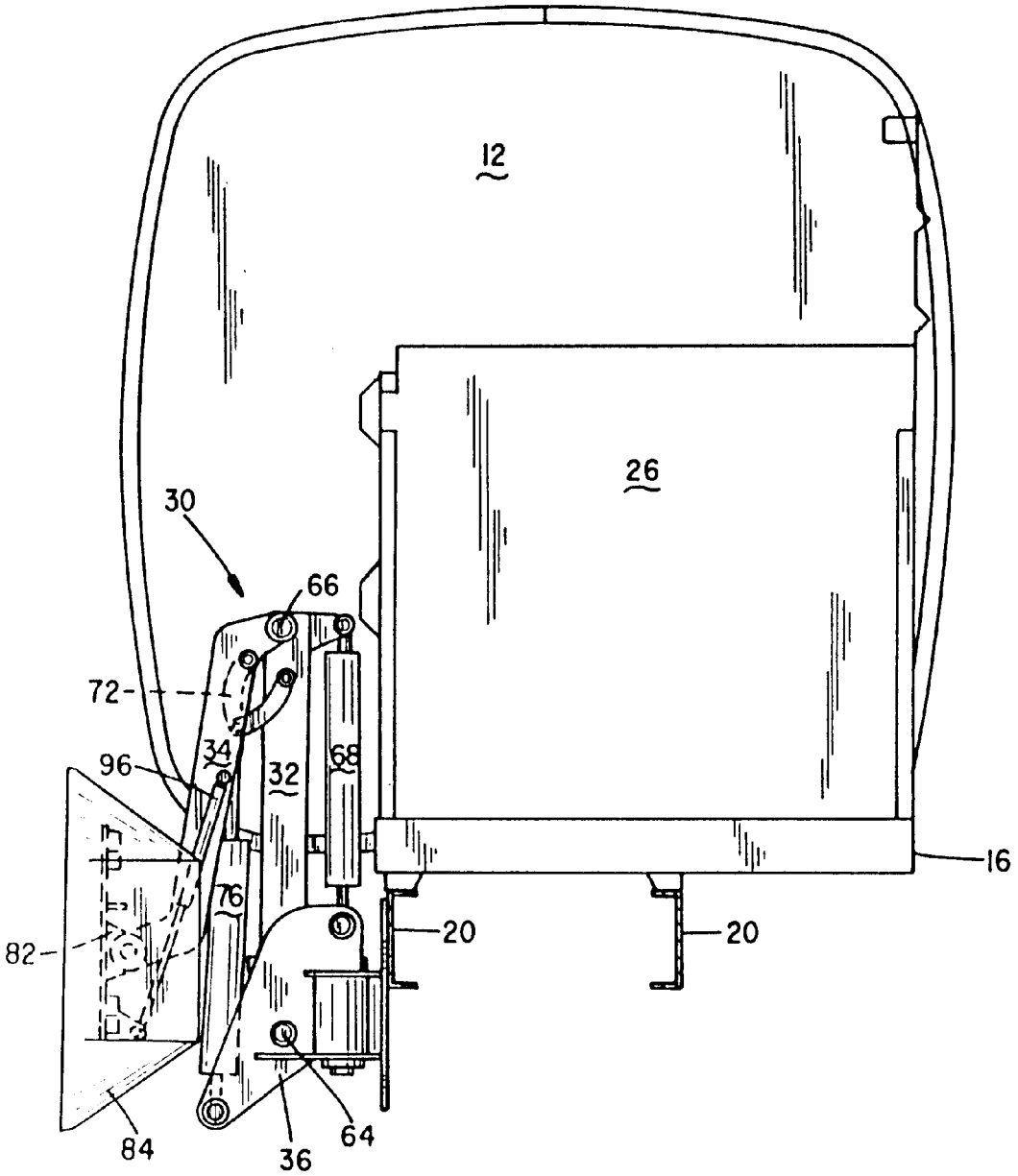
FIG. 13 is a cross-sectional view taken along line 13—13 of FIG. 11.

As one moves on to FIGS. 11–18, an alternate embodiment of the loading device 28 appears. The loading device 28 as shown in FIGS. 11–13 is attached to a support member 82 which rotates on a horizontal axis in a vertical plane, by hydraulic cylinder 96. The support member is attached to an end of the reach member 34. Scoops 84 and 86 are operated closed by hydraulic cylinders 88 and 90 respectively, pivoting on hinges 92 and 94 of known construction. In use, when the reach limb 34 extends outward, the cylinder 96 is retracted pivoting support member 82 to rotate the clamshell so that the open ends of scoops 84 and 86 face downward. Hydraulic cylinders 88 and 90 may then actuate scoops 84 and 86 around a horizontal axis through a vertical plane to a closed position, thereby scooping a desired object into then formed clamshell or bucket 56. When the scoops 84 and 86 are closed, an open end 98 is formed in the front portion of the clamshell (see FIG. 15). An inner portion 100 and 102 of each scoop 84 and 86 respectively, is angled and rounded, whereby materials enclosed by the clamshell easily slide out when the clamshell is placed in the dumping position. Those skilled in the art will appreciate that the mechanized arm 30 and swivel mount 36 as described above, may likewise be incorporated into this embodiment of the invention. Of course, the loading device may be mounted to other conventional loading arm systems.

Figure 14:
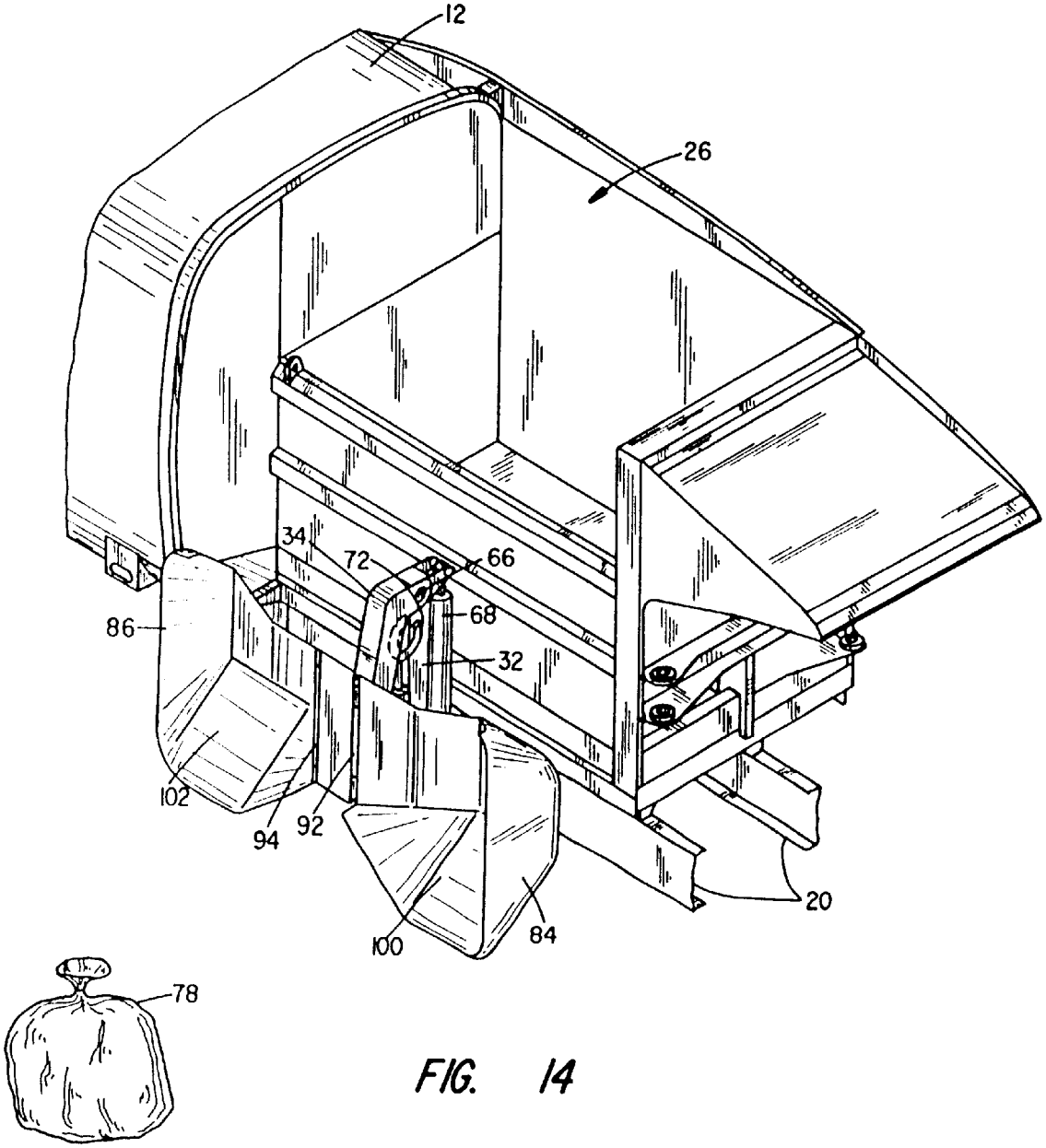
FIG. 14 is an enlarged fragmentary perspective view of the loading device of FIG. 11 in a stowed position.
Figure 15:
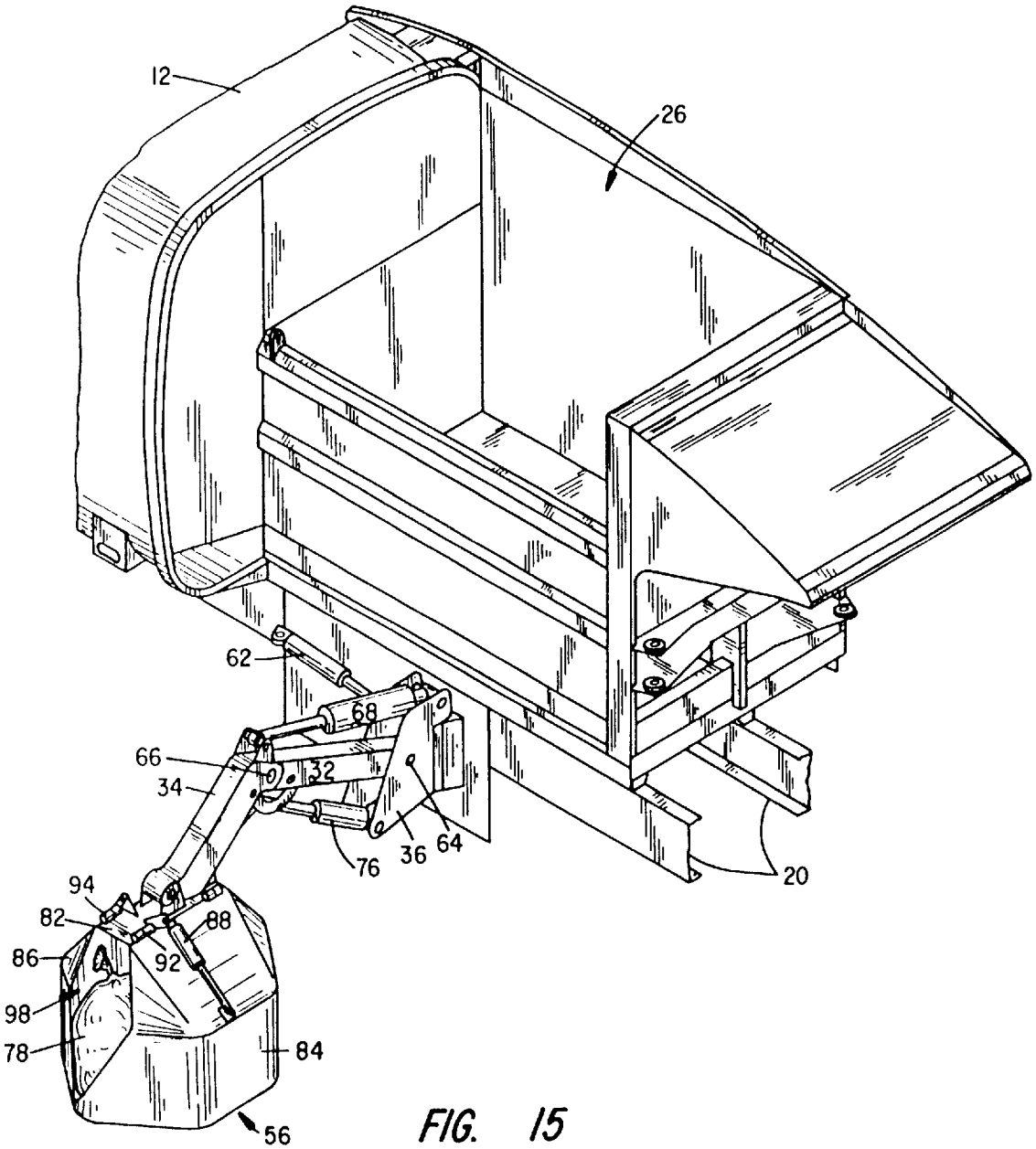
FIG. 15 is an enlarged fragmentary perspective view of the loading device of FIG. 11 in an extended and actuated position, capturing a soft-sided container.
Figure 16:
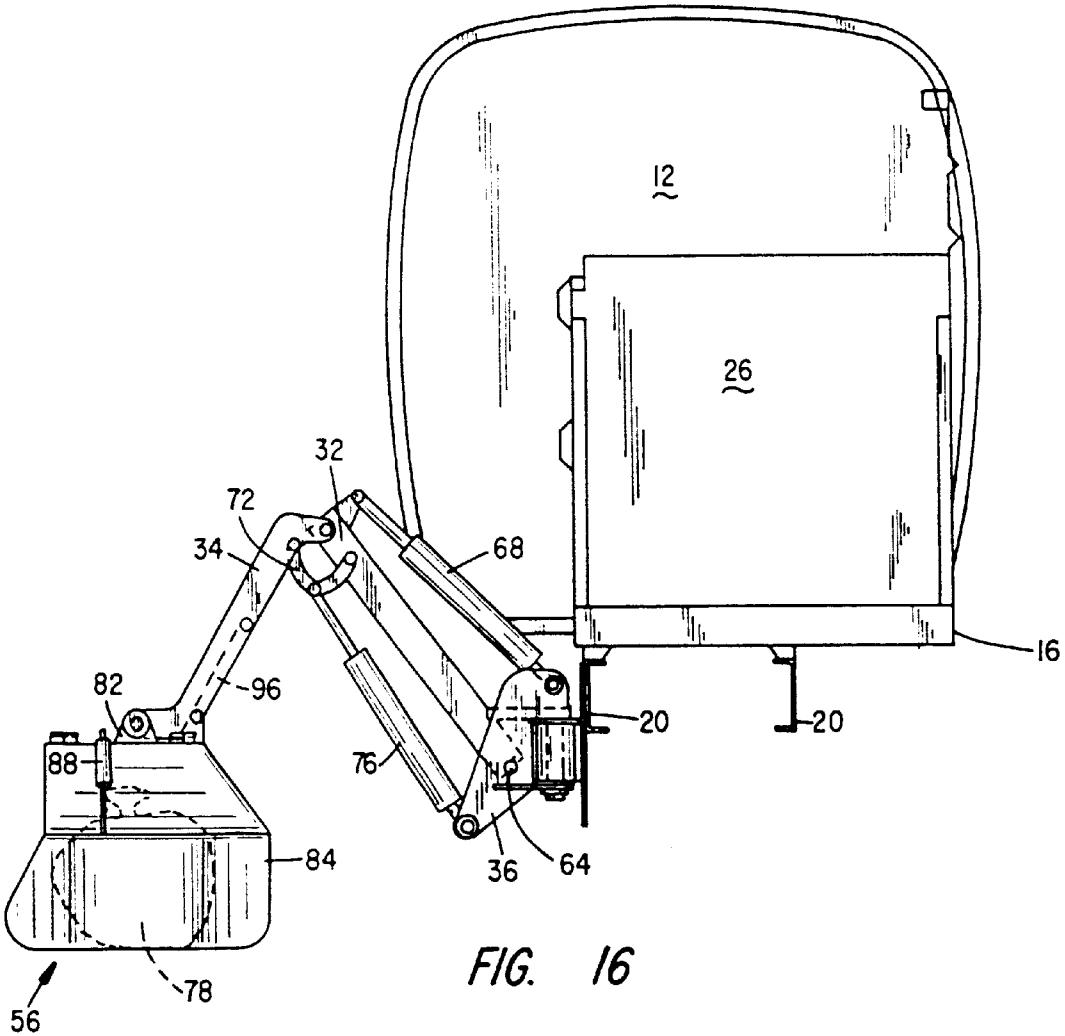
FIG. 16 is a front elevational view, partially in section, of the loading device of FIG. 15.
Figure 17:
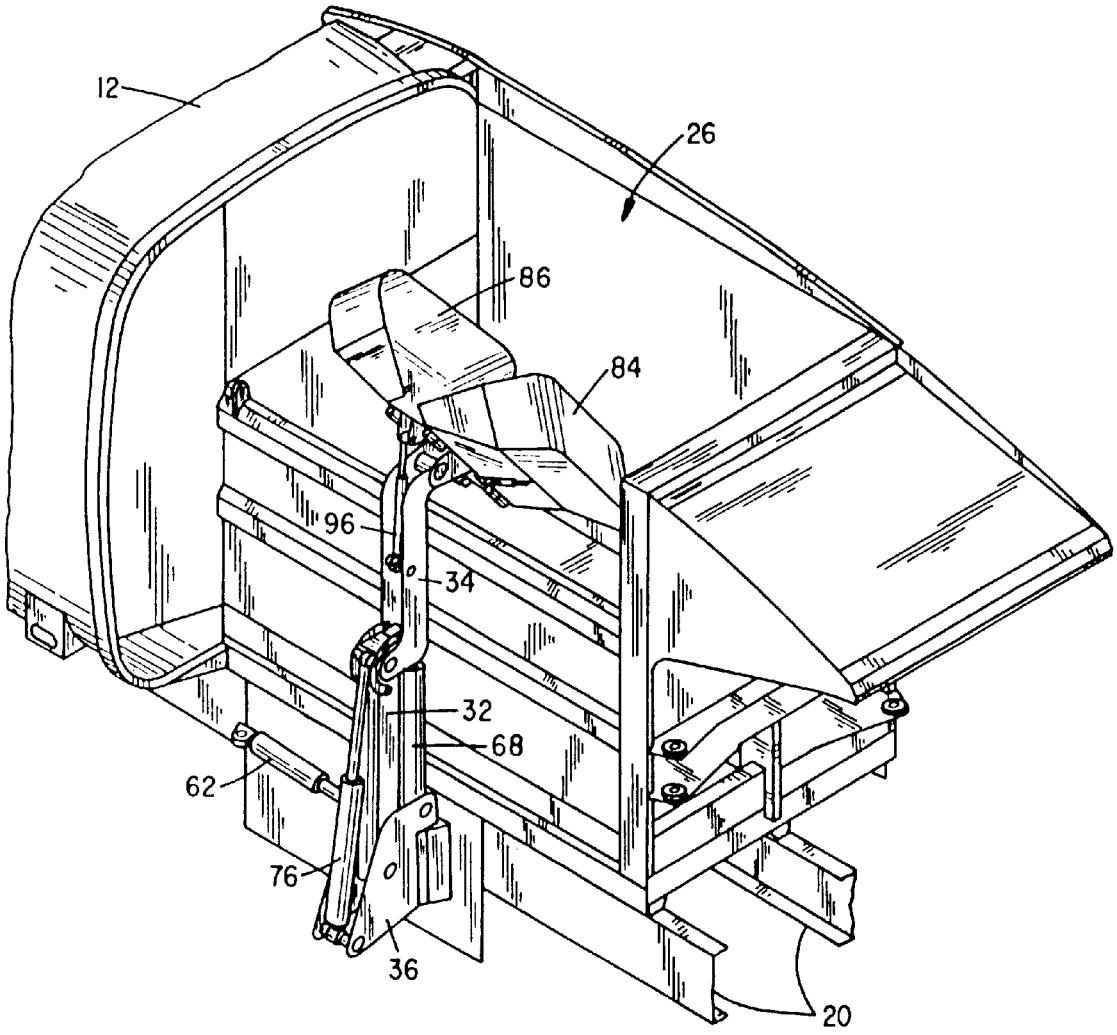
FIG. 17 is an enlarged fragmentary perspective view of the loading device of FIG. 11 in a dumping position.
Figure 18:
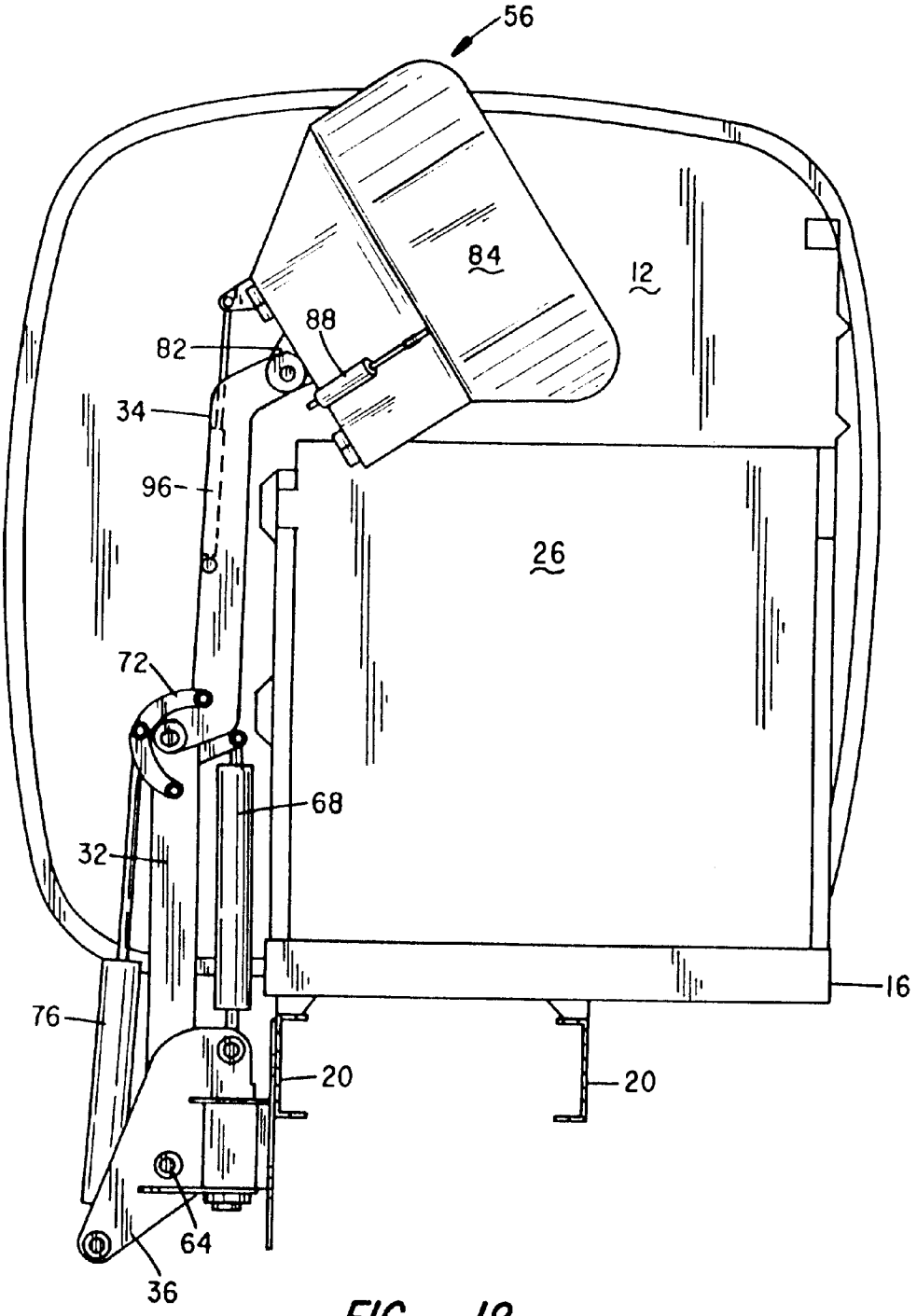
FIG. 18 is a front elevational view, partially in section, of the loading device of FIG. 11 in a dumping position.
Figure 19:
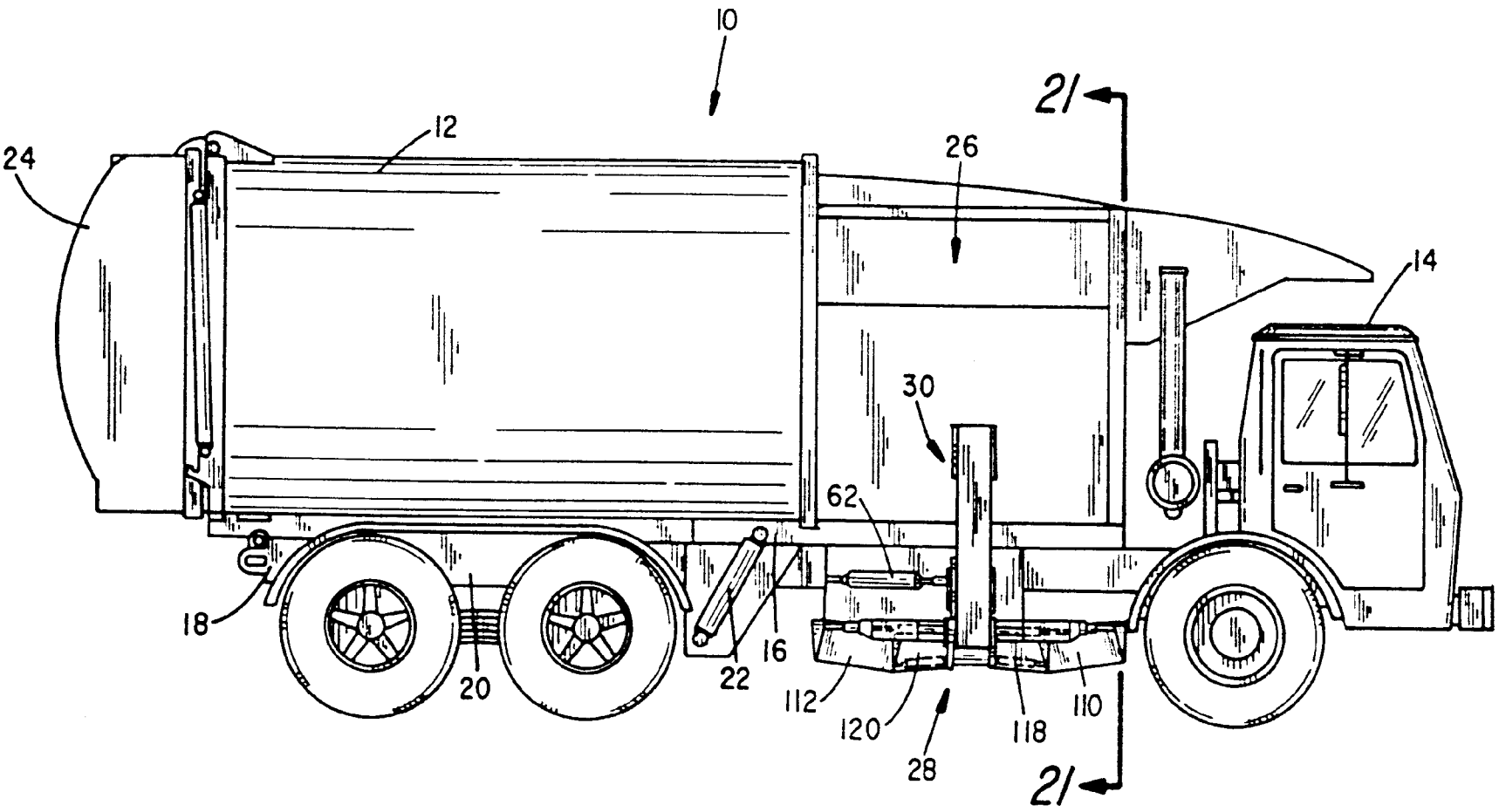
FIG. 19 is a side elevational view of a side loading refuse vehicle including an alternate embodiment of the invention.
Figure 20:
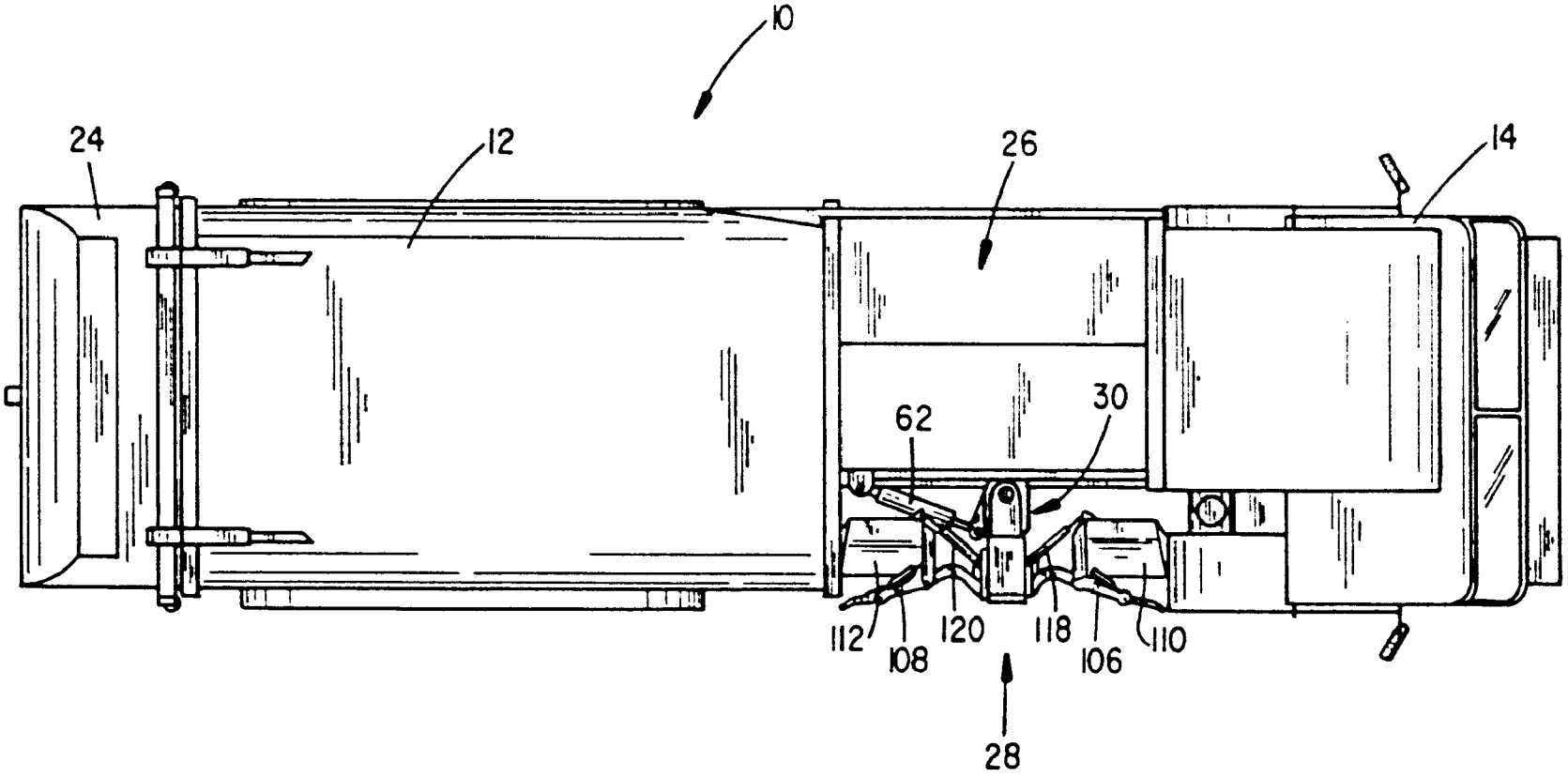
FIG. 20 is a top plan view of the side loading refuse vehicle shown in FIG. 19.
Figure 21:
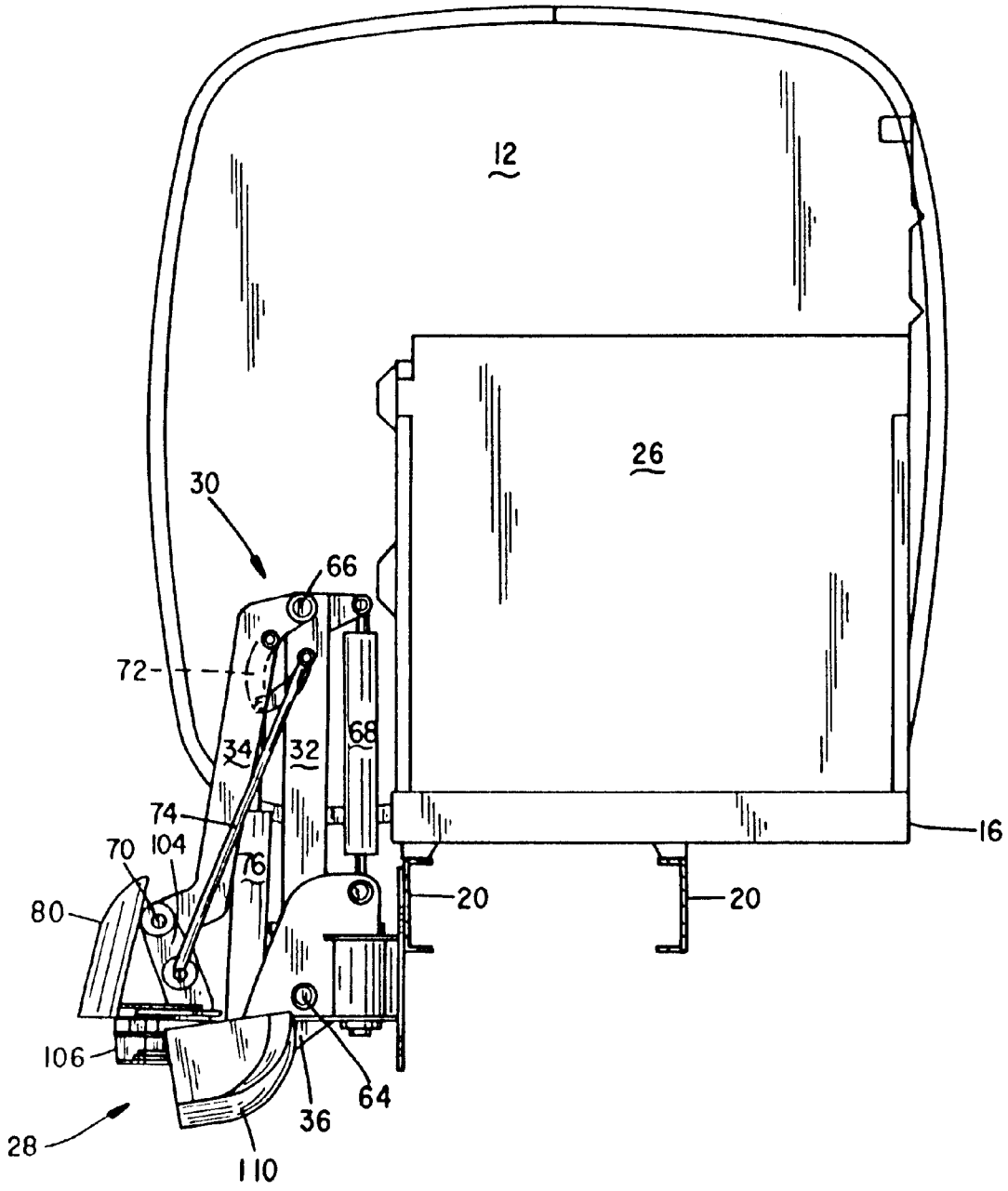
FIG. 21 is a cross-sectional view taken along line 21—21 of FIG. 19.
Figure 22:
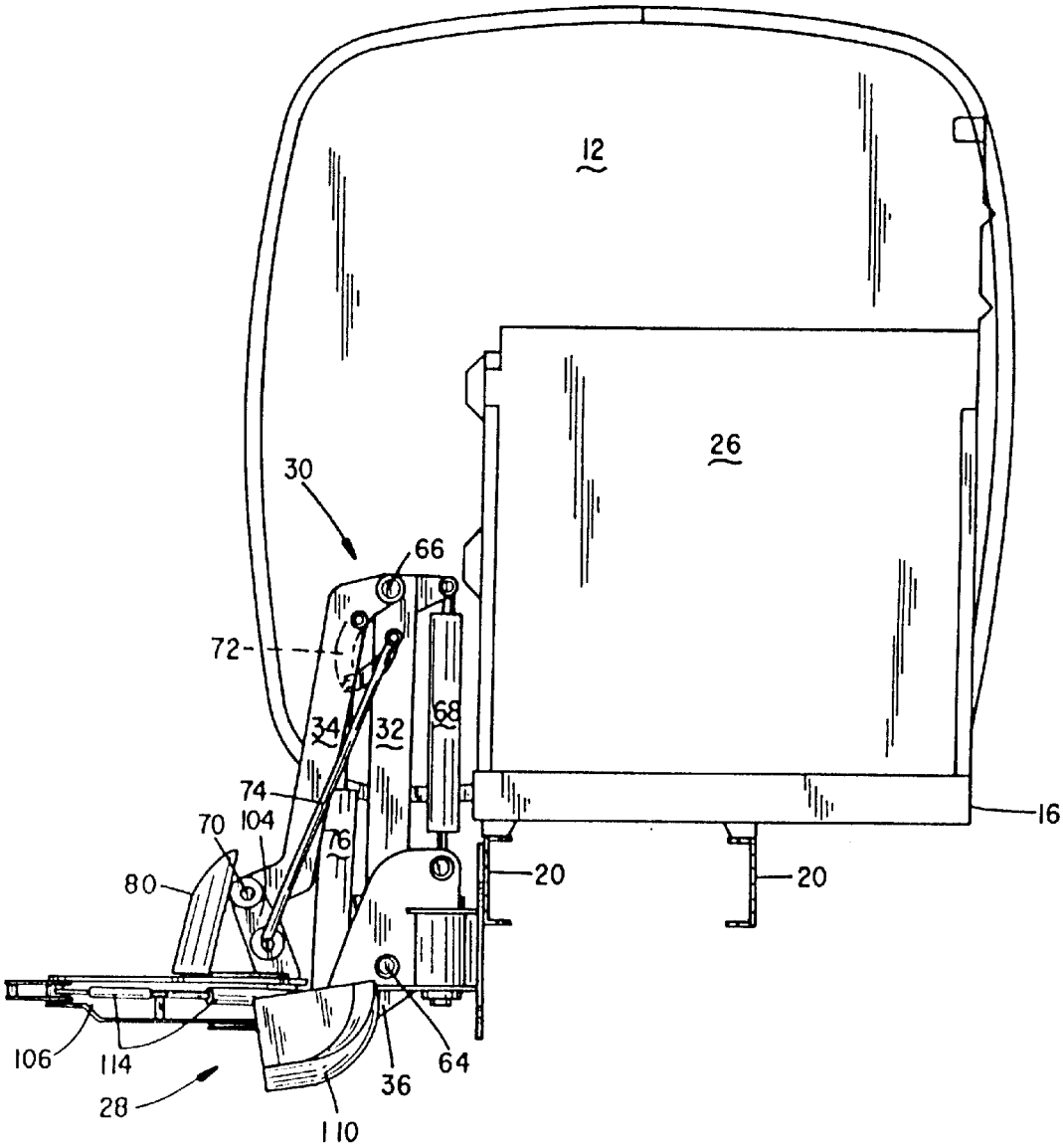
FIG. 22 is a front elevational view, partially in section, of the side loading refuse vehicle shown in FIG. 19, wherein the scoops are in their stowed position and the grabber is in its actuated position.
Figure 23:
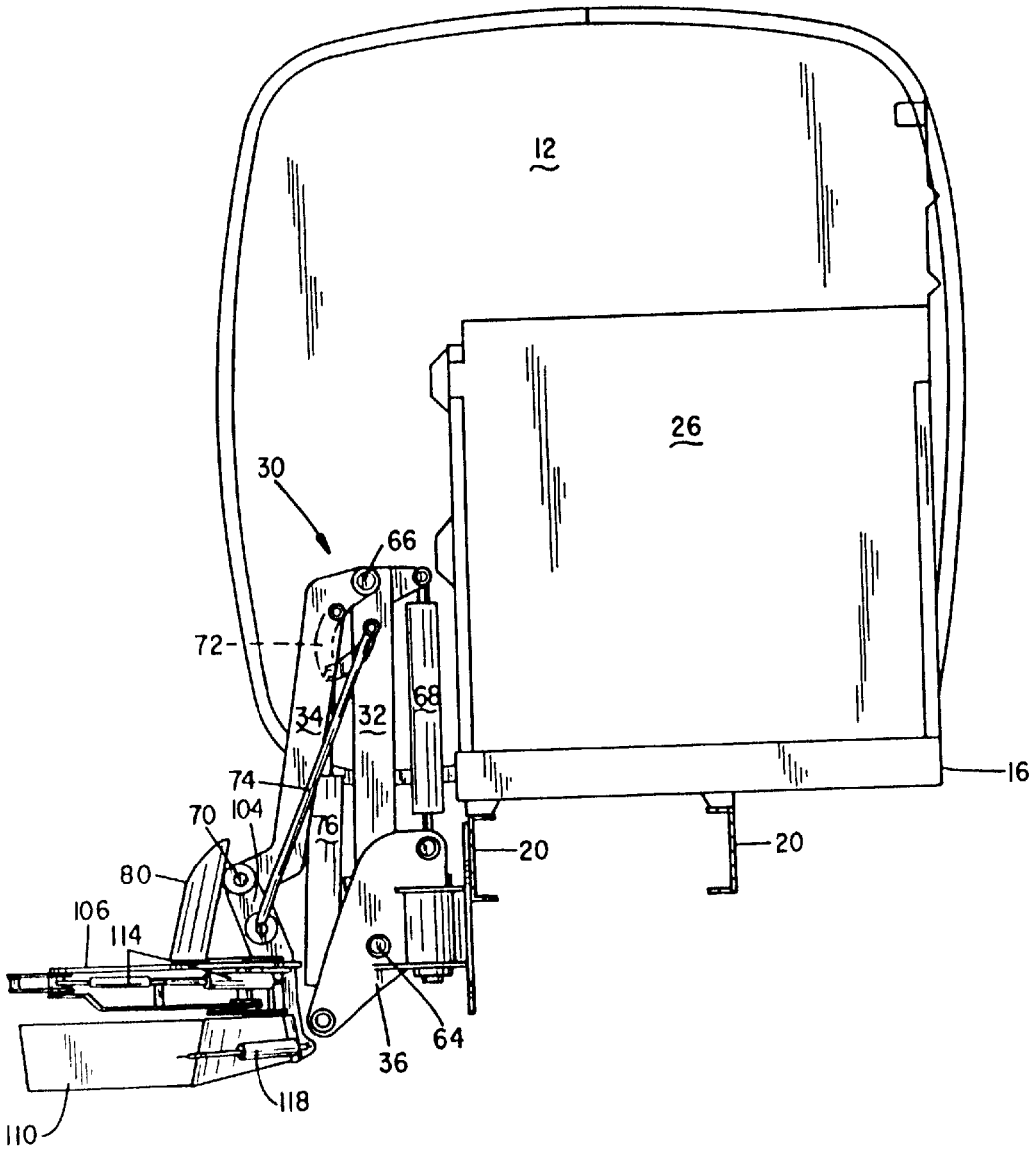
FIG. 23 is a front elevational view, partially in section, of the side loading refuse vehicle shown in FIG. 19, wherein the scoops and grabber are in their actuated positions.
Figure 24:
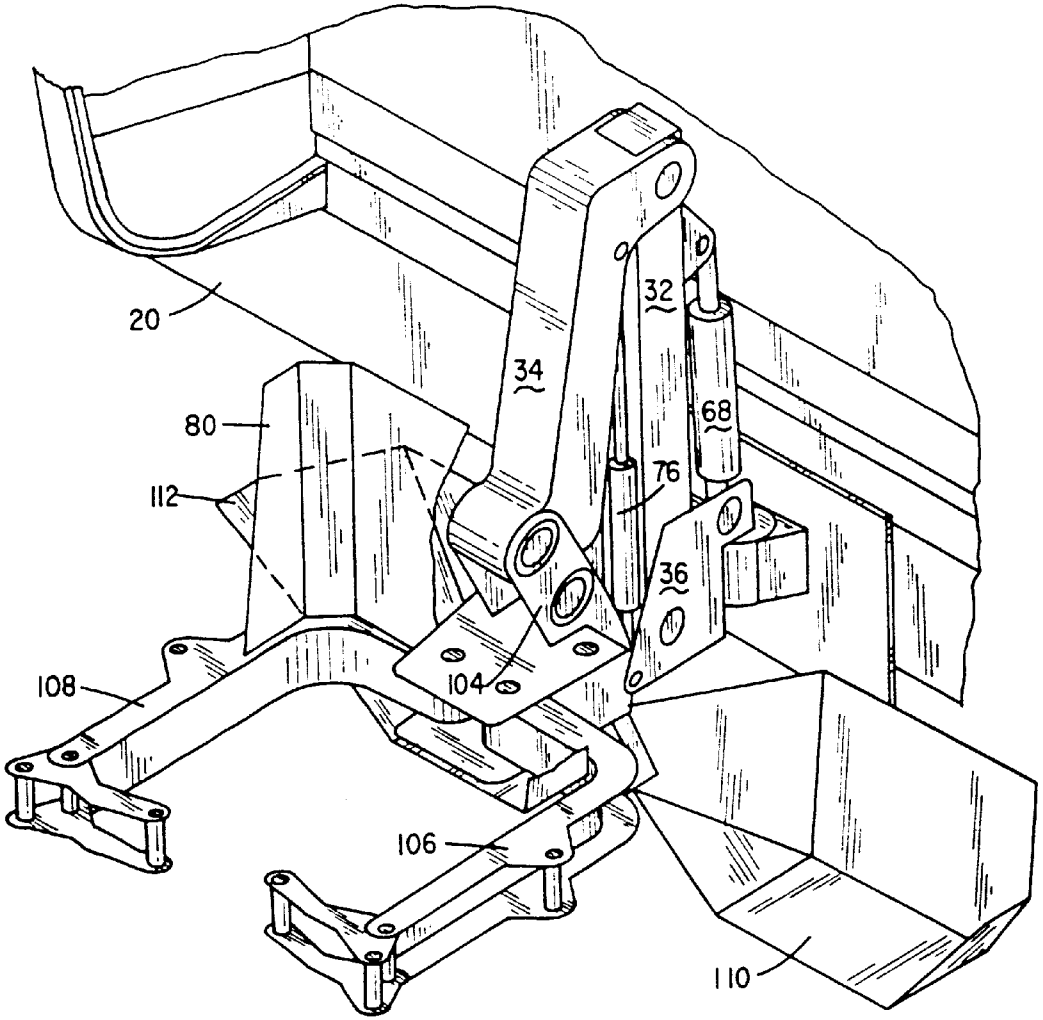
FIG. 24 is an enlarged fragmentary perspective view of the loading device shown in FIG. 22.

In a series of FIGS. 14–18, various positions of the clamshell of FIGS. 11–18 are shown. FIG. 14 shows the scoops 84 and 86 in their stowed position. FIG. 15 shows the lift and reach members 32 and 34 in their extended position, and the scoops 84 and 86 rotated and pivoted to their closed position, thereby scooping and enclosing the soft sided container 78. FIG. 16 shows the front view of the lift and reach members 32 and 34 being retracted back towards the refuse body 12. FIGS. 17 and 18 shows the lift and reach members 32 and 34 in their dumping positions, wherein the scoops 82 and 84 are opened to allow the soft sided container 78 to completely dump out of the generally defined clamshell or bucket 56.

Referring now to FIGS. 19–32, another embodiment of the loading device 28, is shown. The loading device generally indicated by numeral 28 includes articulated arms 106 and 108 and horizontal scoops 110 and 112. The loading device is attached to a support member 104. The articulated arms 106 and 108 of a grabber and horizontal scoops 110 and 112 of a clamshell are pivotally attached by hinges of known construction to the support member 104. The articulated arms 106 and 108 are articulated closed by pairs of hydraulic cylinders 114 and 116 respectively. The specific features of the grabber are further disclosed in co-pending application filed Nov. 21, 1994, Ser. No. 08/342,752, now U.S. Pat. No. 5,863,086, issued via FWC application Ser. No. 08/815,675, and assigned to the same assignee as the present application, the entire disclosure of which is incorporated herein by reference.

The horizontal scoops 110 and 112 are articulated closed by hydraulic cylinders 118 and 120. The horizontal scoops 110 and 112, attached to support member 104, may have a similar design and construction as scoops 38 and 40 already described. The support member 104 is pivotally attached to the mechanized arm 30. Those skilled in the art will appreciate that the articulated arms 106 and 108 of the grabber may be operated independently or in conjunction with the operation of scoops 110 and 112 of the clamshell. Also, the mechanized arm 30 and swivel mount 36 as described above, may likewise be incorporated into this embodiment of the invention.

Figure 25:
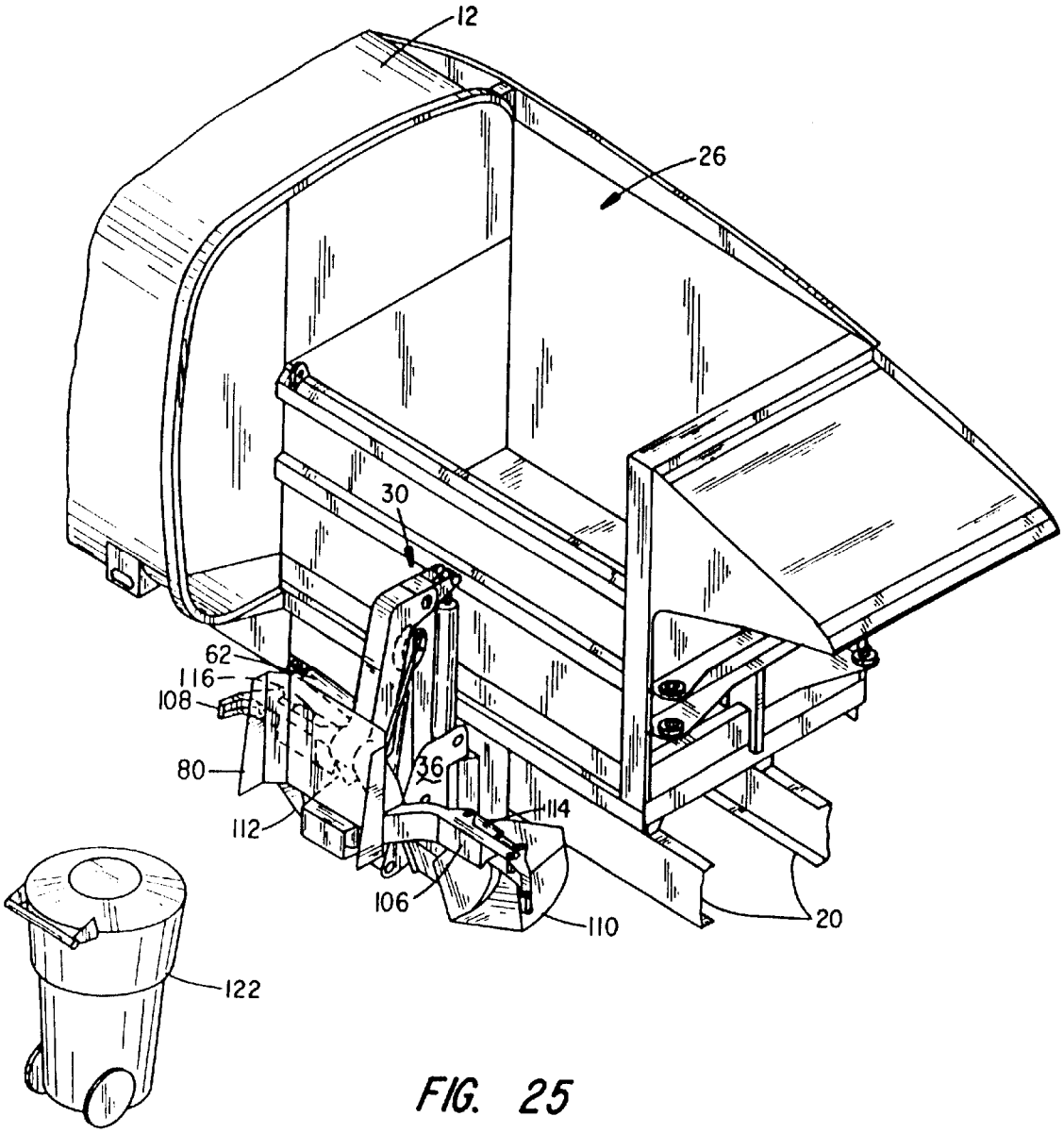
FIG. 25 is an enlarged fragmentary perspective view of the loading device of FIG. 19, shown in its stowed position.
Figure 26:
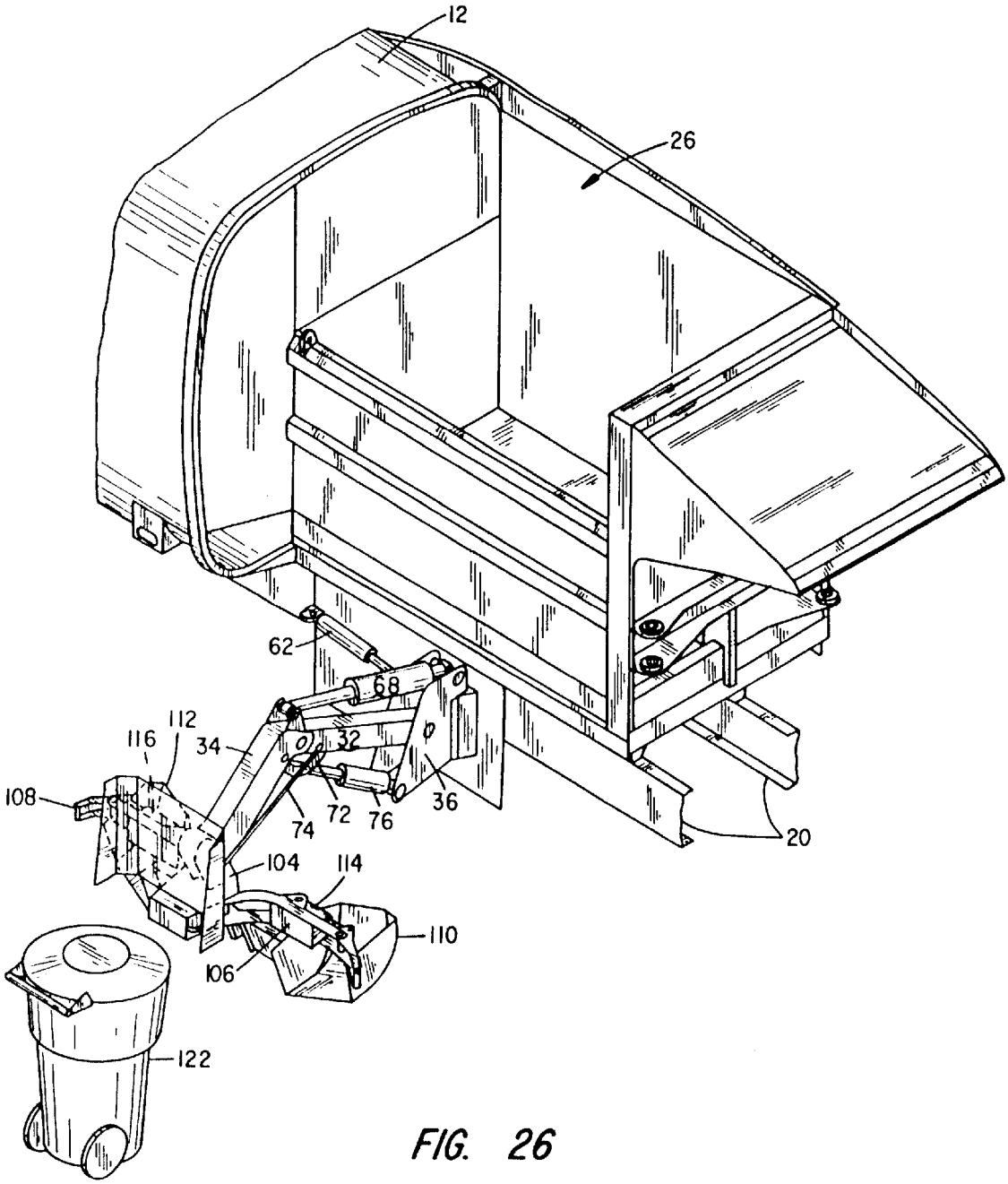
FIG. 26 is an enlarged fragmentary perspective view of the loading device of FIG. 19, shown in an extended position.
Figure 27:
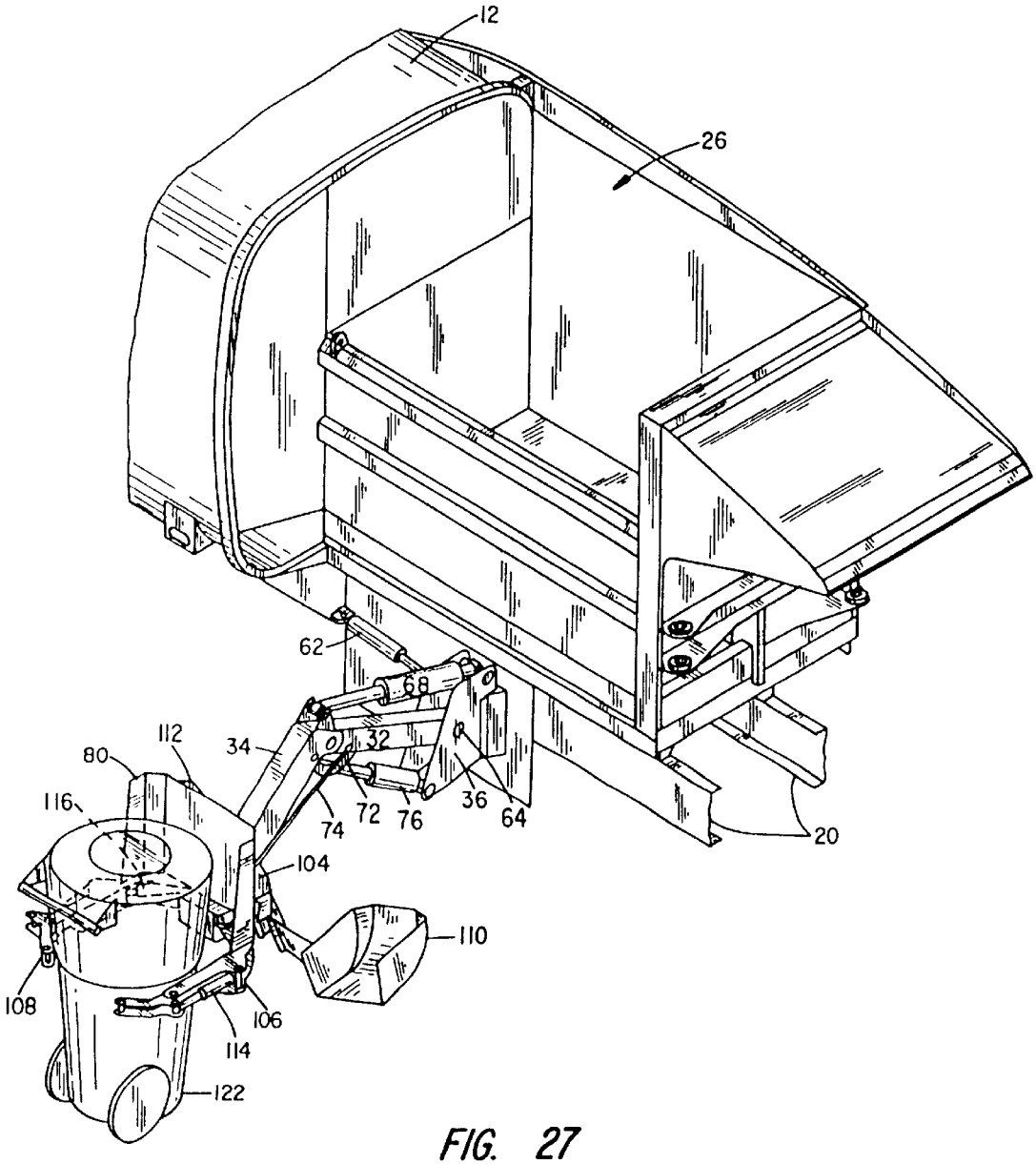
FIG. 27 is an enlarged fragmentary perspective view of the loading device of FIG. 19, shown in an extended position, wherein the grabber is shown in an actuated position engaging a rigid container.
Figure 28:
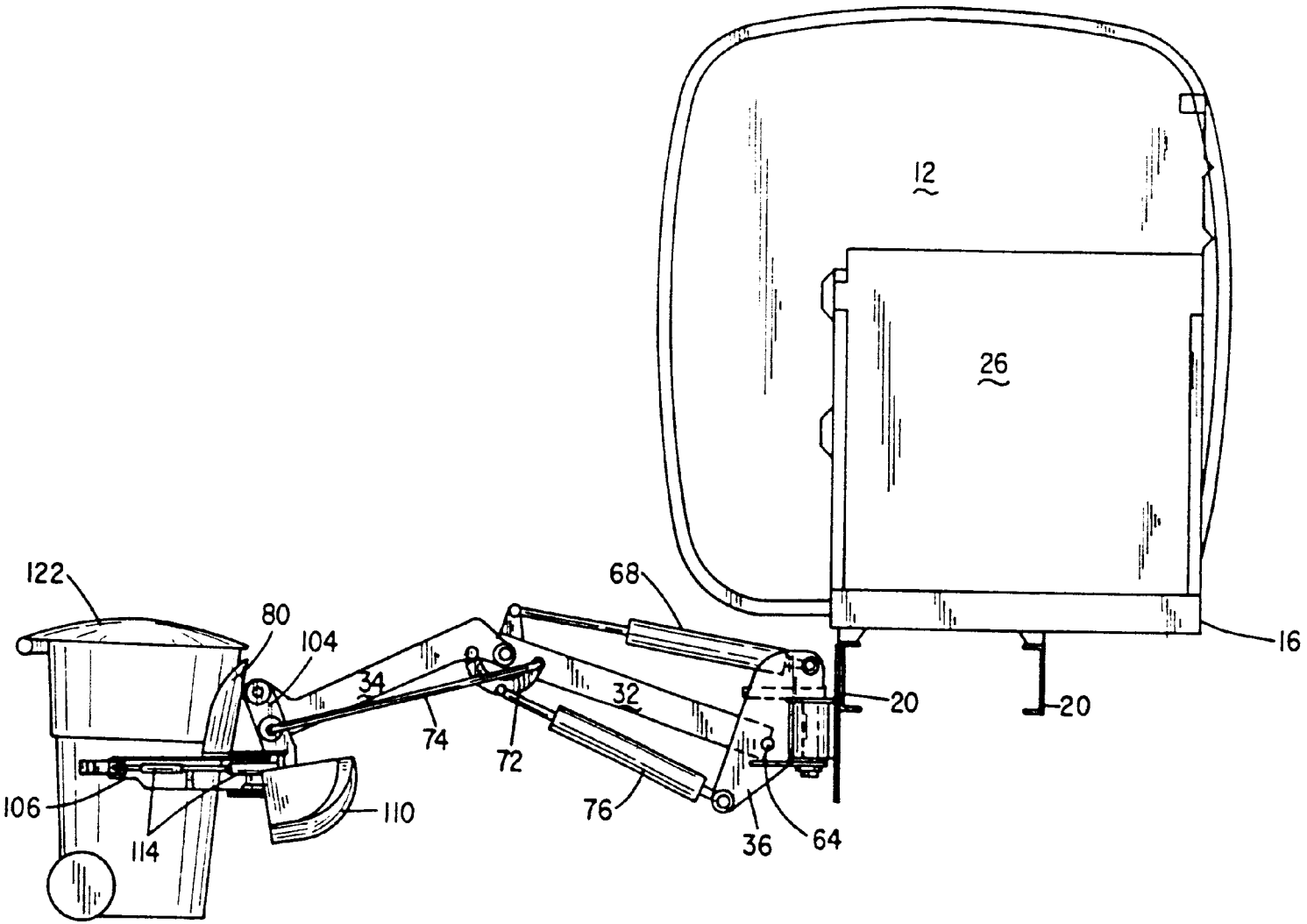
FIG. 28 is a front elevational view, partially in section, of the loading device in its extended position as shown in FIG. 27, engaging the rigid container.

In use, when the reach limb 34 extends outward, either or both the articulated arms 106 and 108 and the horizontal scoops 110 and 112 may actuate through a horizontal plane to a closed position, thereby scooping and/or grabbing a desired object. In a series of FIGS., 25–32, various positions of the combination grabber and clamshell of FIGS. 19–32 are shown. FIG. 25 shows the scoops 110 and 112 and articulated arms 106 and 108 in their stowed position, but aligned with a rigid container 122. FIG. 26 shows the lift and reach members 32 and 34 in their extended position. FIGS. 27 and 28 show articulated arms 106 and 108 grasping the rigid container 122.

Figure 29:
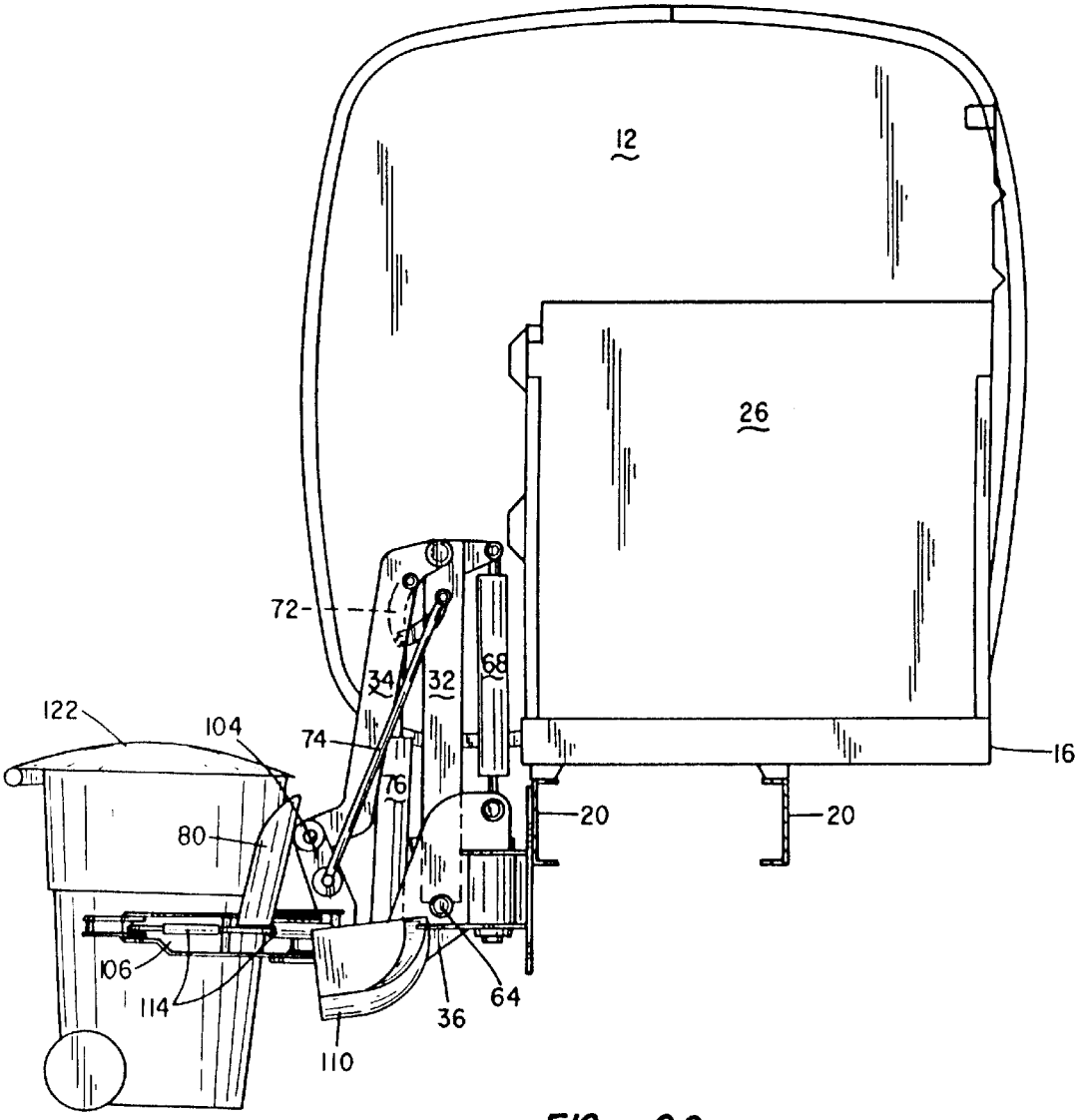
FIG. 29 is a front elevational view, partially in section, of the loading device of FIG. 19, shown in its stowed position, wherein the grabber is shown in an actuated position, engaging the rigid container.
Figure 30:
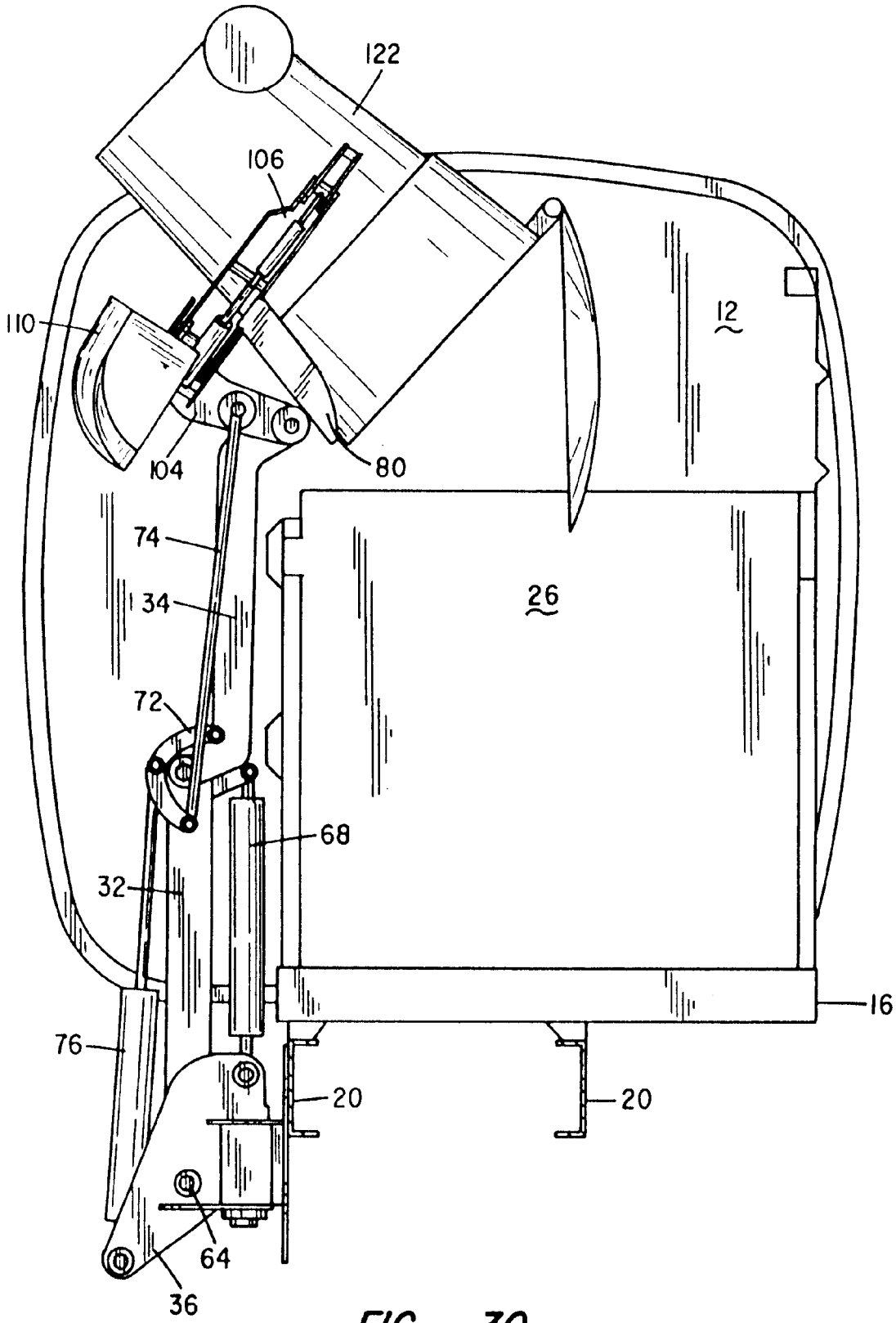
FIG. 30 is a front elevational view, partially in section, of the loading device of FIG. 19 in a dumping position, engaging the rigid container.

FIG. 29 shows the lift and reach members 32 and 34 being retracted back towards the refuse collector body 12, while the articulated arms 106 and 108 continue to grasp the rigid container 122. FIG. 30 shows the lift and reach members 32 and 34 in their dumping positions, wherein the rigid container is inverted, causing the container's lid to rotate open, allowing the contents within the container 122 to completely dump out of the container 122.

Figure 31:
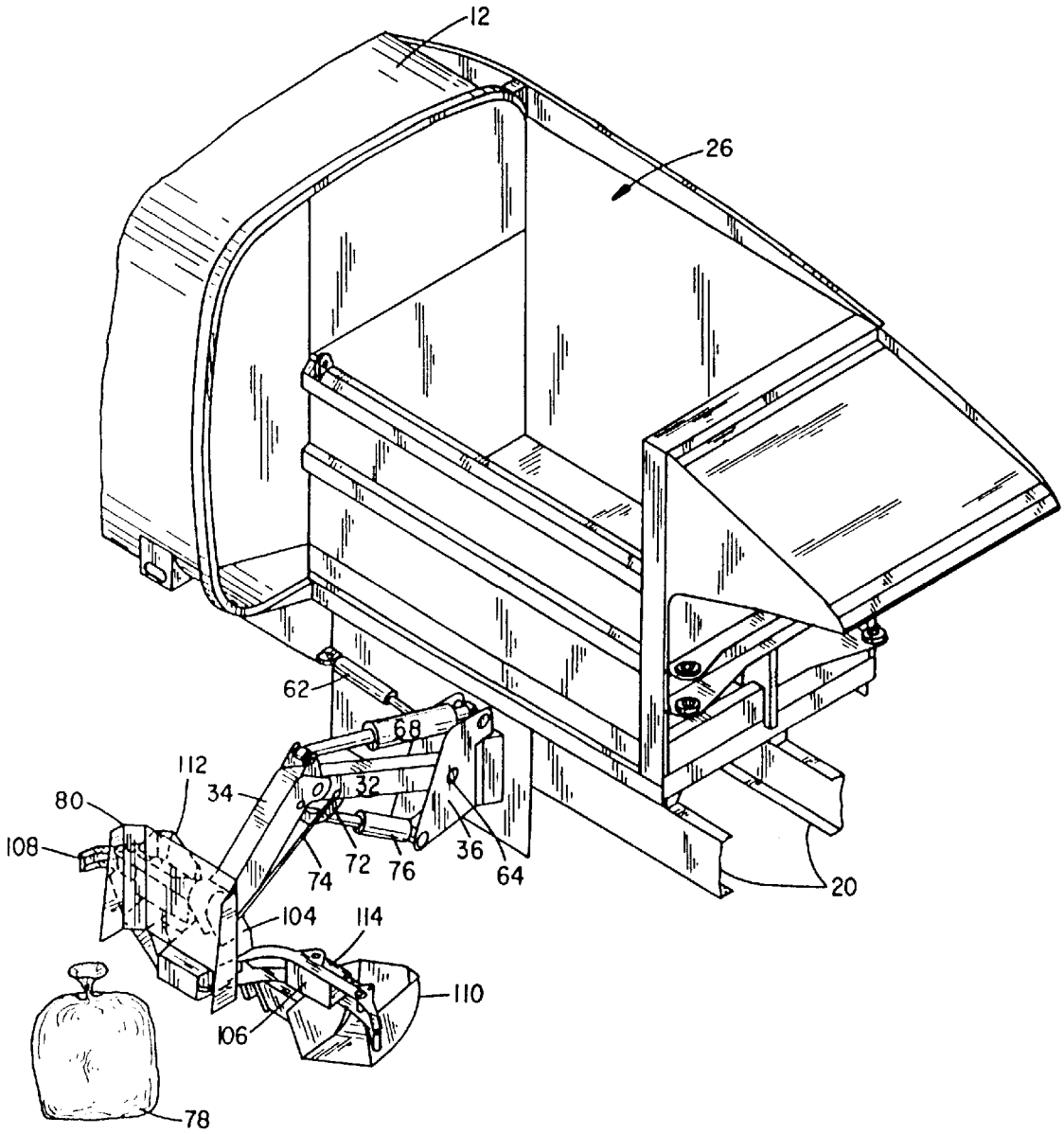
FIG. 31 is a fragmentary perspective view of the loading device of FIG. 19, shown in an extended position, and aligned with a soft-sided bag.
Figure 32:
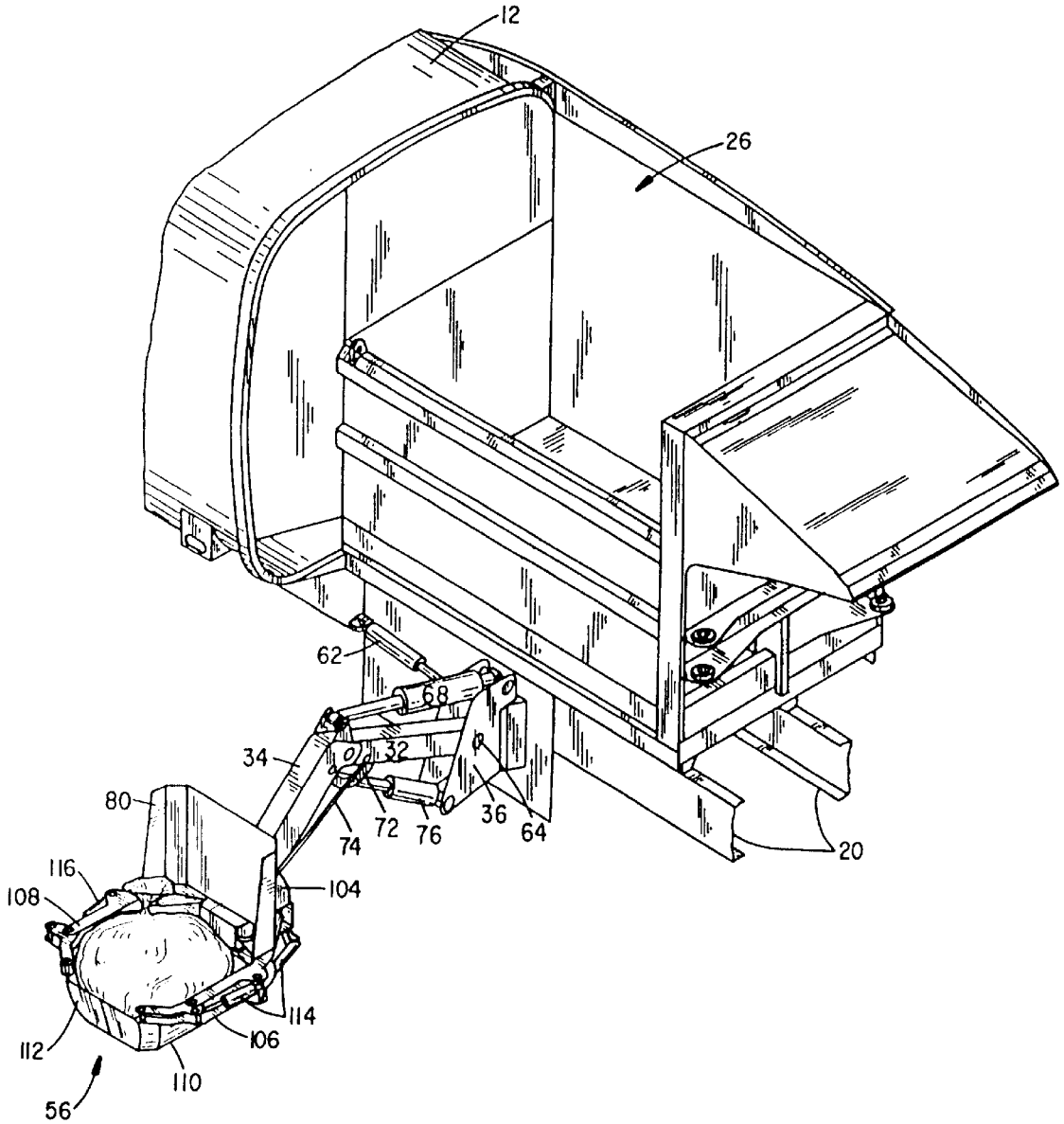
FIG. 32 is a fragmentary perspective view of the loading device of FIG. 19, shown in an extended and articulated position, with a soft-sided bag captured within the clamshell.
Figure 33:
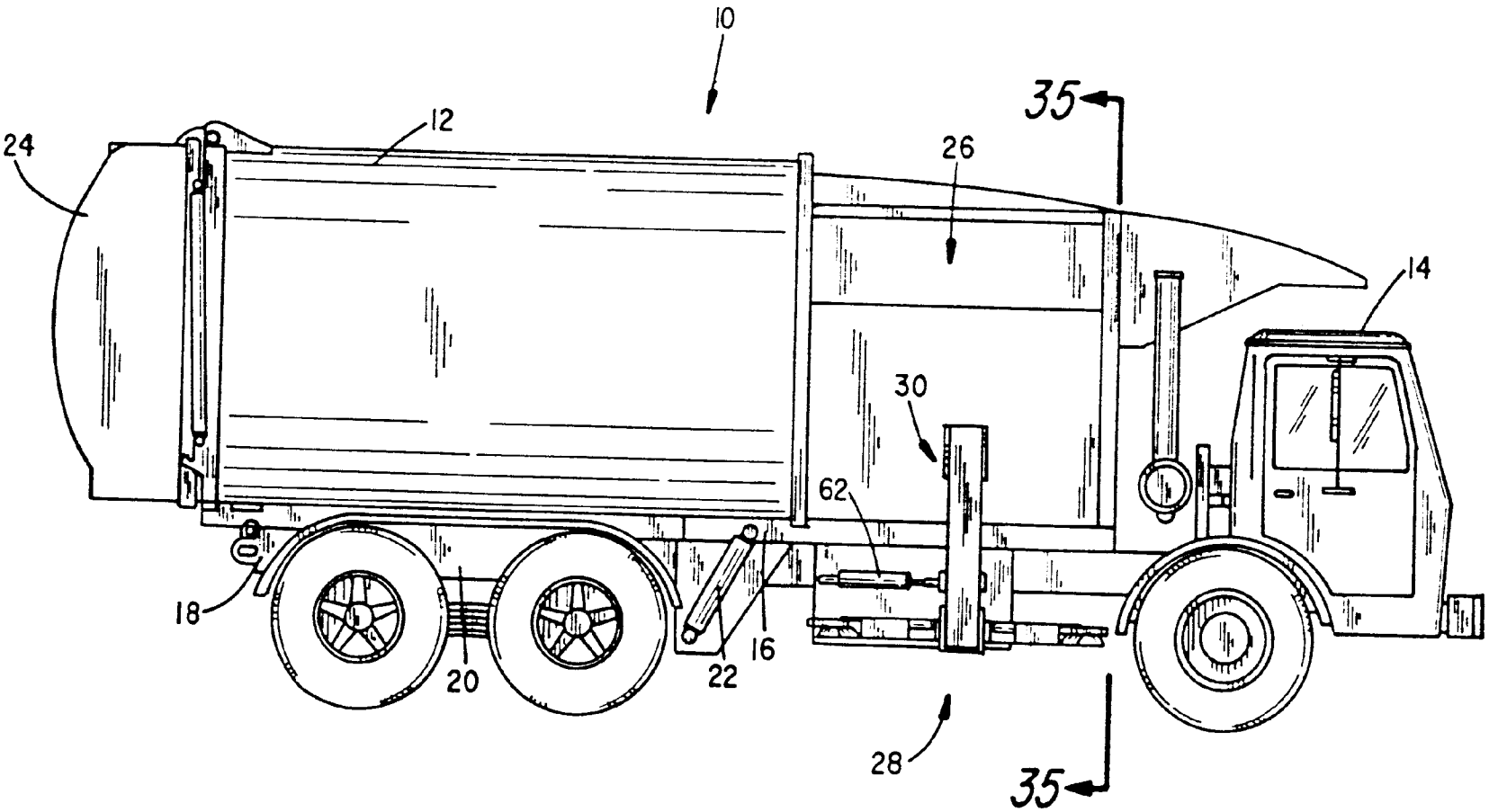
FIG. 33 is a side elevational view of a side loading refuse vehicle including an alternate embodiment of the invention.
Figure 34:
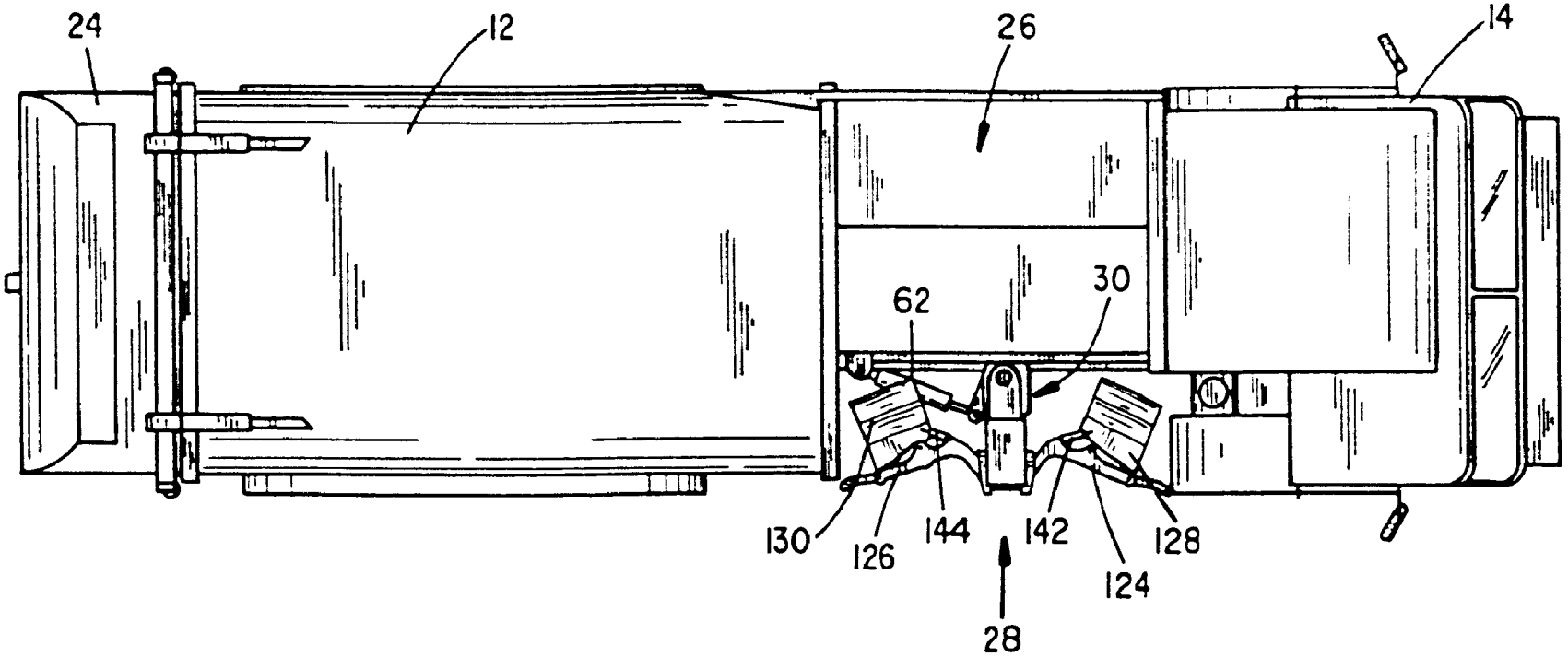
FIG. 34 is a top plan view of the side loading refuse vehicle shown in FIG. 33.
Figure 35:
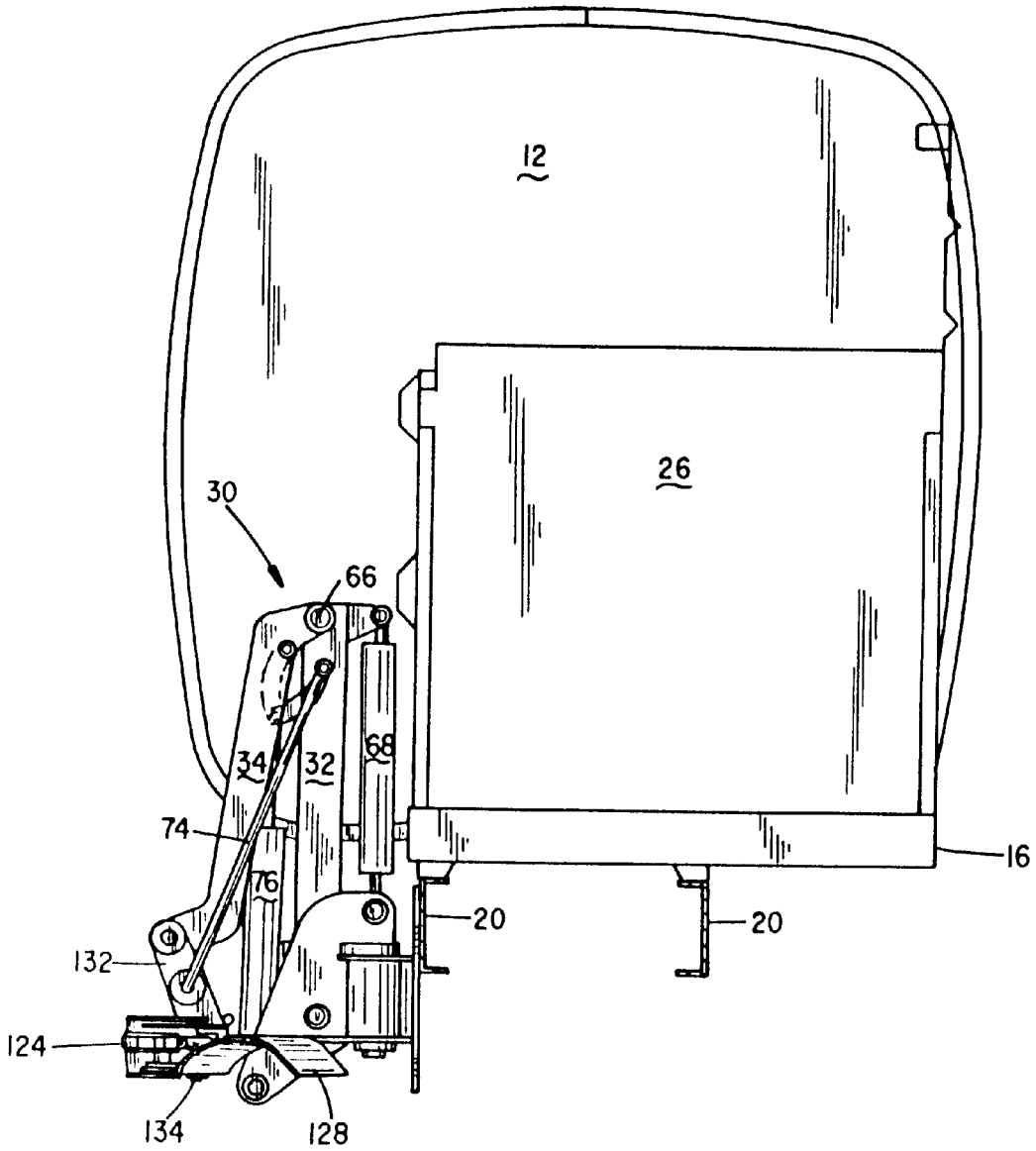
FIG. 35 is a cross-sectional view taken along line 35—35 of FIG. 33.

FIGS. 31 and 32 show the lift and reach members 32 and 34 in their extended position and aligned with a soft-sided bag 78. The scoops 110 and 112 are actuated closed, scooping under the soft-sided bag 78. The grabber arms 106 and 108 are closed to aid in retaining the top portion of the soft-sided bag. As lift and reach members 32 and 34 reach their dumping positions, the grabber arms 106 and 108 and the scoops 110 and 112 may be opened slightly. A deflector shield 80, as described above, may be attached to the support member 104, to deflect the soft-sided bag 78 into the charging hopper and away from the articulated arms 106 and 108.

Another alternate embodiment is shown in FIGS. 33–45. The loading device, generally indicated by numeral 28, includes a pair of articulated arms 124 and 126 each having a scoop or blade 128 and 130 respectively pivotally attached thereto by hinges 134 and 136 of known construction. The articulated arms 124 and 126 are attached to a support member 132. The articulated arms 124 and 126 are articulated closed by hydraulic cylinders 138 and 140 respectively. Again, as indicated above, the more specific features of the grabber may be obtained from the above referenced and incorporated co-pending application Ser. No. 08/342,752.

The scoops or blades 128 and 130 are closed by hydraulic cylinders 142 and 144. The blades 128 and 130 scoop underneath the associated grabber arms 124 and 126, forming a clamshell and preventing a grasped object from slipping out of the grabber arms. Those skilled in the art will appreciate that the arms 124 and 126 may be operated independently or in conjunction with the operation of the blades 128 and 130. of course, the mechanized arm 30 and swivel mount 36 as described above, may likewise be incorporated into this embodiment of the invention as well.

Figure 36:
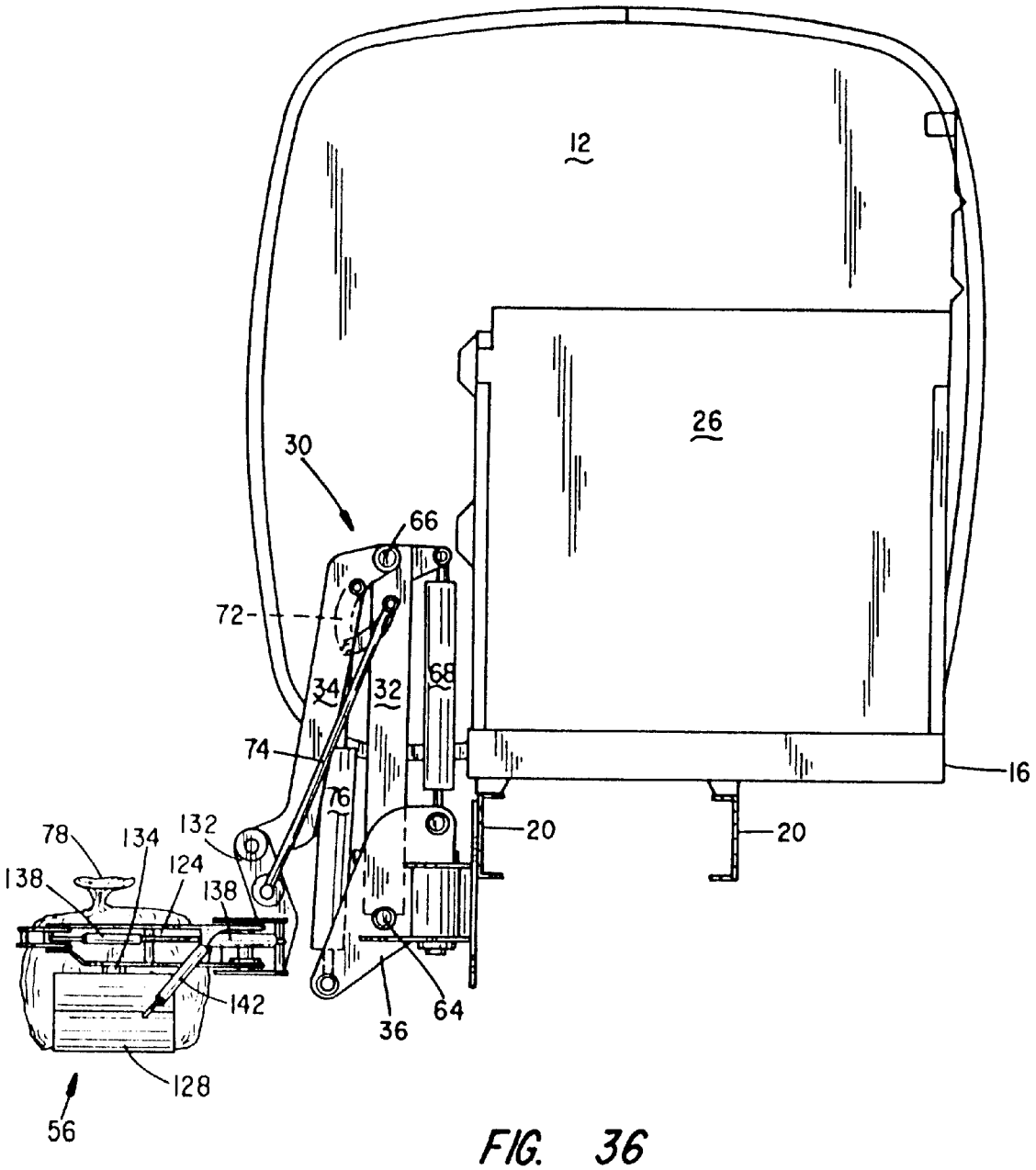
FIG. 36 is a front elevational view, partially in section, of the side loading refuse vehicle shown in FIG. 33, wherein the mechanized arm is in its stowed position, while the grabber and scoops are in their actuated positions, with a soft-sided bag captured within the clamshell.
Figure 37:
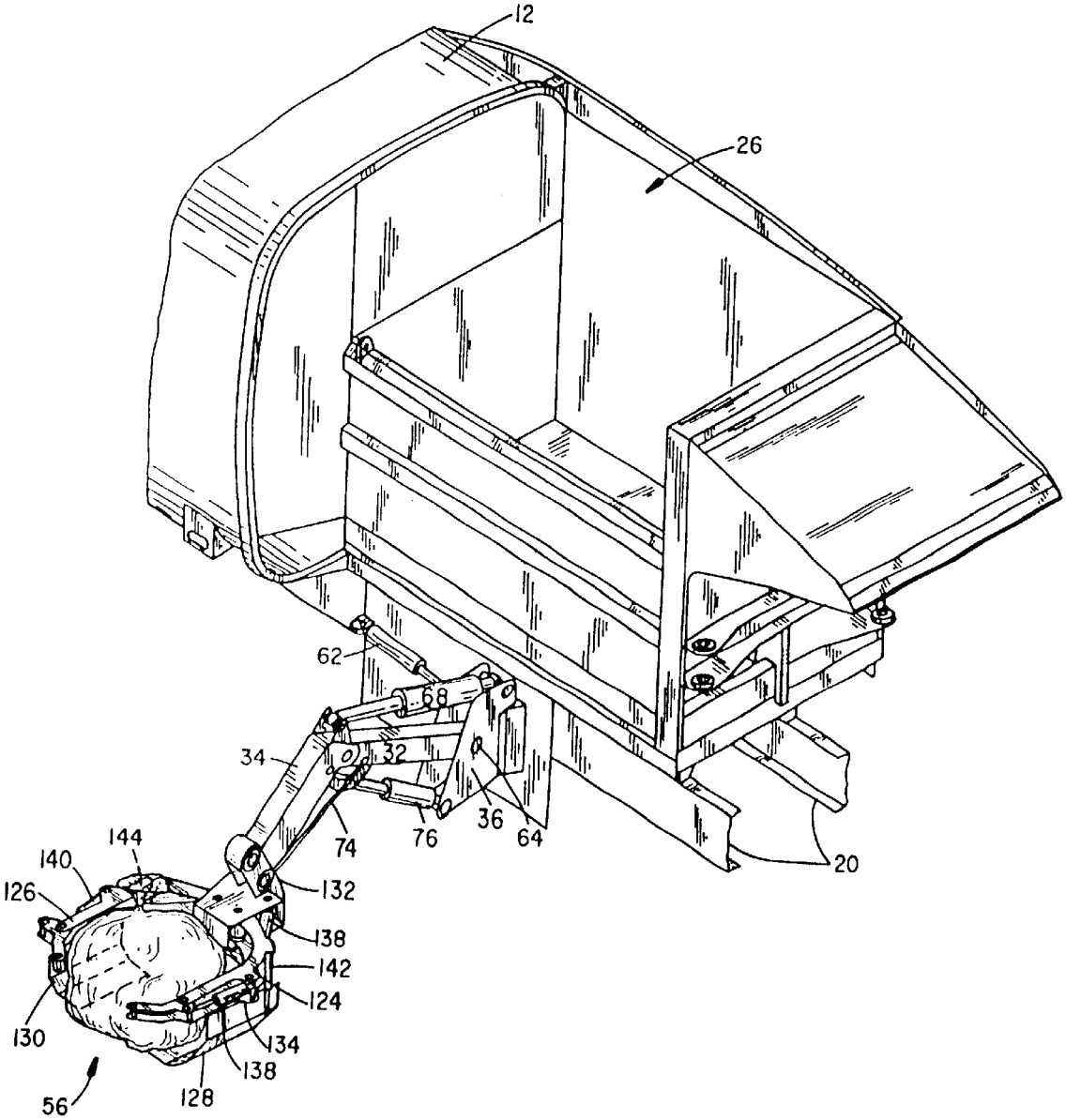
FIG. 37 is an enlarged fragmentary perspective view of the loading device and mechanized arm of FIG. 33, shown in their extended and actuated position, with a soft-sided bag captured within the clamshell.
Figure 38:
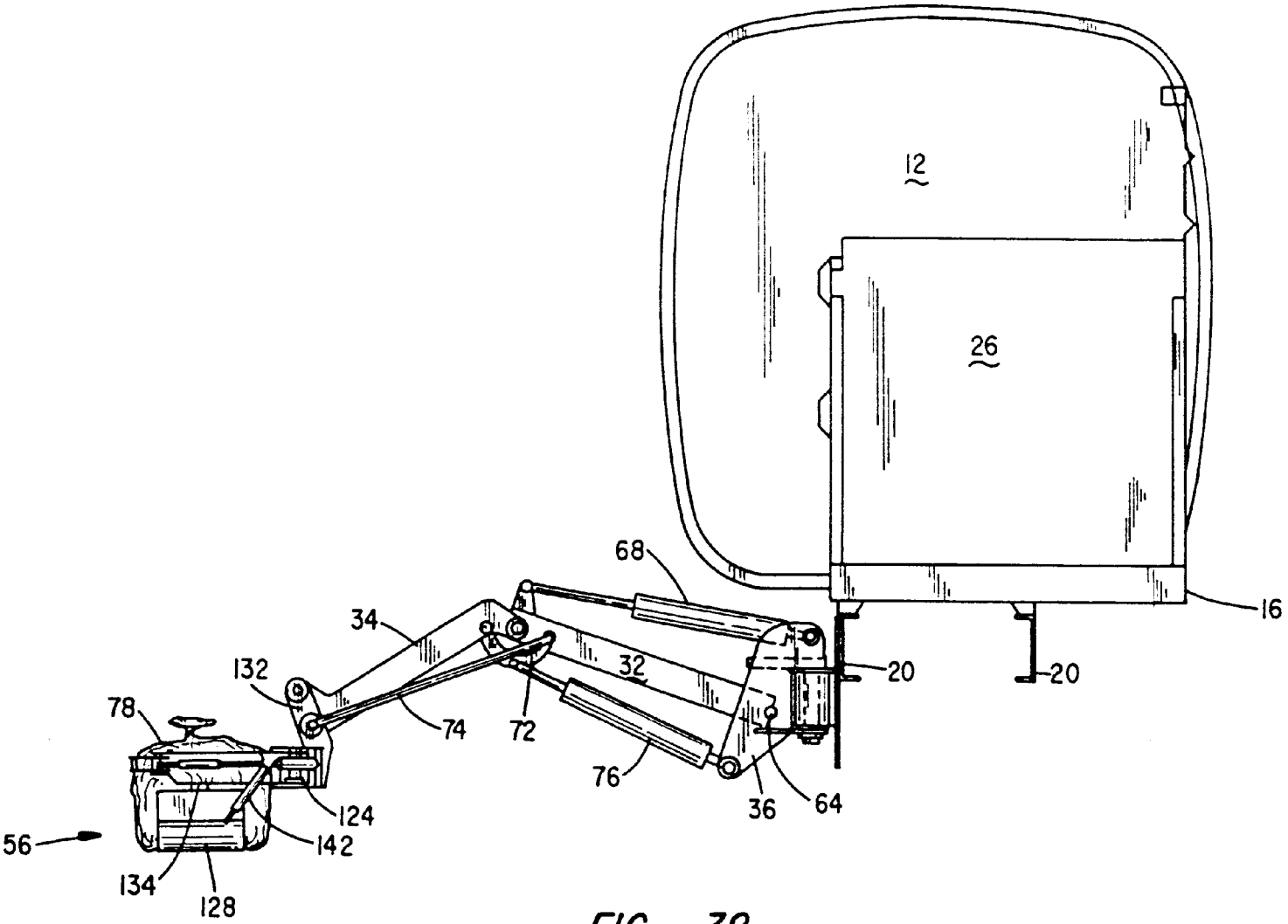
FIG. 38 is a front elevational view, partially in section, of the loading device and mechanized arm in their extended and actuated position as shown in FIG. 37.

In use, when the reach limb 34 extends outward, the articulated arms 124 and 126 and the scoops or blades 128 and 130 may actuate independently or in unison. The articulated arms actuate through a horizontal plane to a closed position, while the blades 128 and 130 actuate through a vertical plane. In a series of FIGS. 36–45, various positions of the combination grabber and clamshell combination of FIGS. 33–45 are shown. FIGS. 36–39 show the grabber and clamshell scooping and dumping a soft-sided container, whereas, FIGS. 40–45 show the grabber clutching and dumping a rigid container. FIG. 36 shows the mechanized arm 30 in its stowed position, and the scoops 128 and 130 and articulated arms 124 and 126 capturing a soft-sided container 78. FIGS. 37 and 38 shows the lift and reach members 32 and 34 in their extended position, and the scoops 128 and 130 and articulated arms 124 and 126 capturing a soft-sided container 78.

Figure 39:
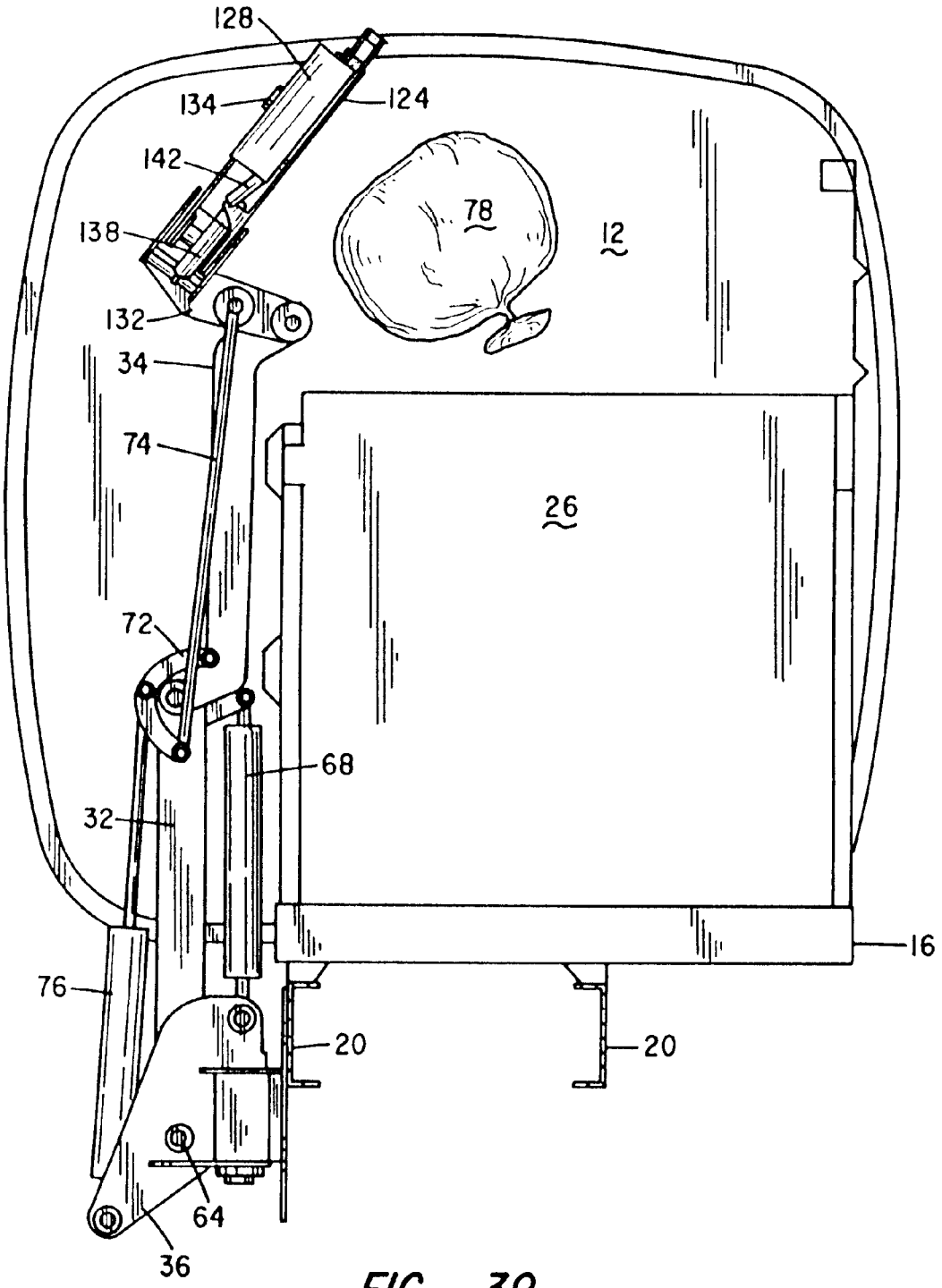
FIG. 39 is a front elevational view, partially in section, of the loading device and mechanized arm of FIG. 33 in a dumping position, with a soft-sided bag released by partial opening of the clamshell.

FIG. 39 shows the lift and reach members 32 and 34 in their dumping positions, wherein the clamshell formed by blades 134 and 136 is inverted and opened and articulated arms 124 and 126 can be opened slightly, causing the soft-sided bag to dump out.

Figure 40:
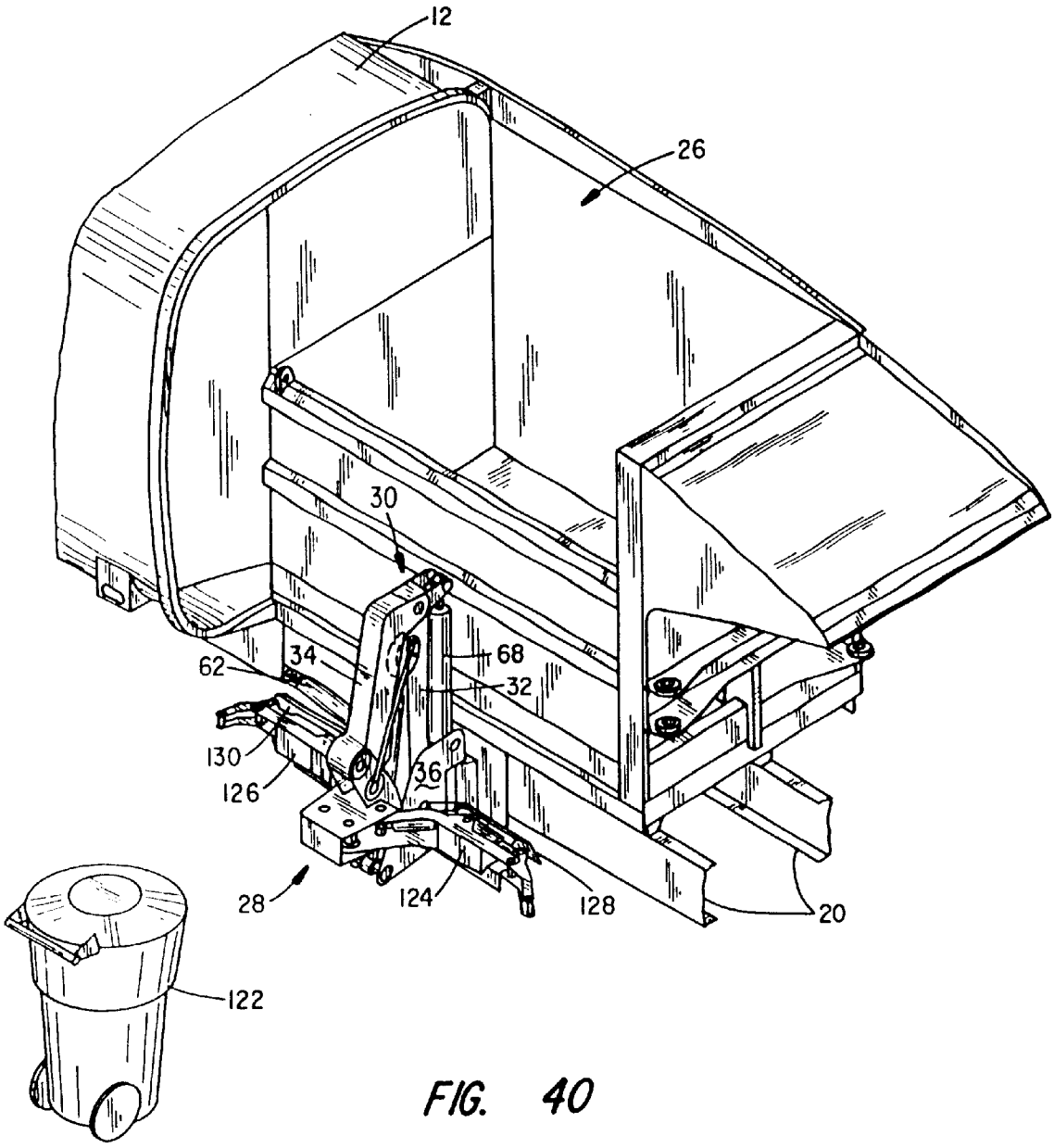
FIG. 40 is a fragmentary perspective view of the loading device of FIG. 33, shown in its stowed position.
Figure 41:
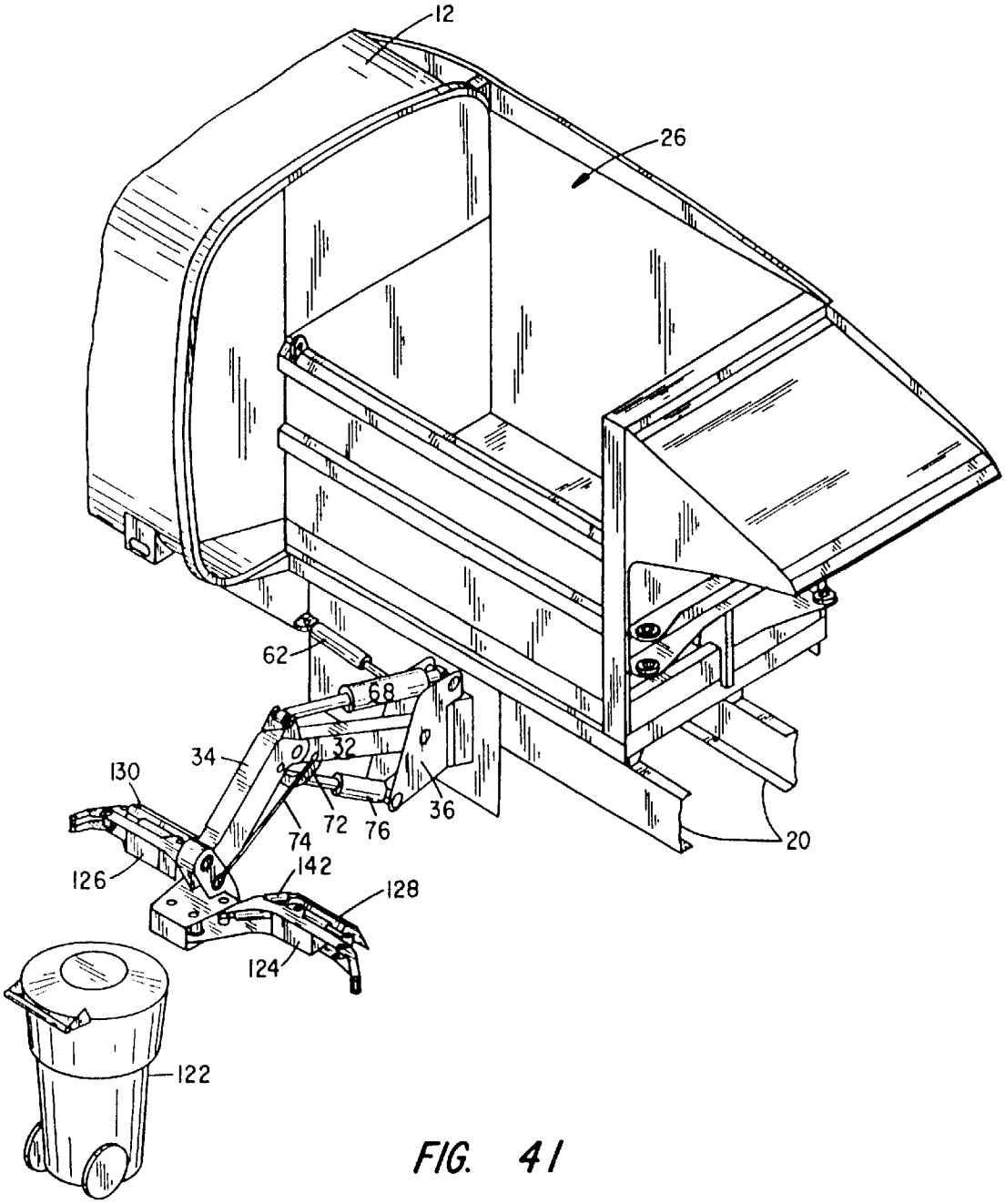
FIG. 41 is a fragmentary perspective view of the loading device of FIG. 33, shown in an extended position, and aligned with a rigid container.
Figure 42:
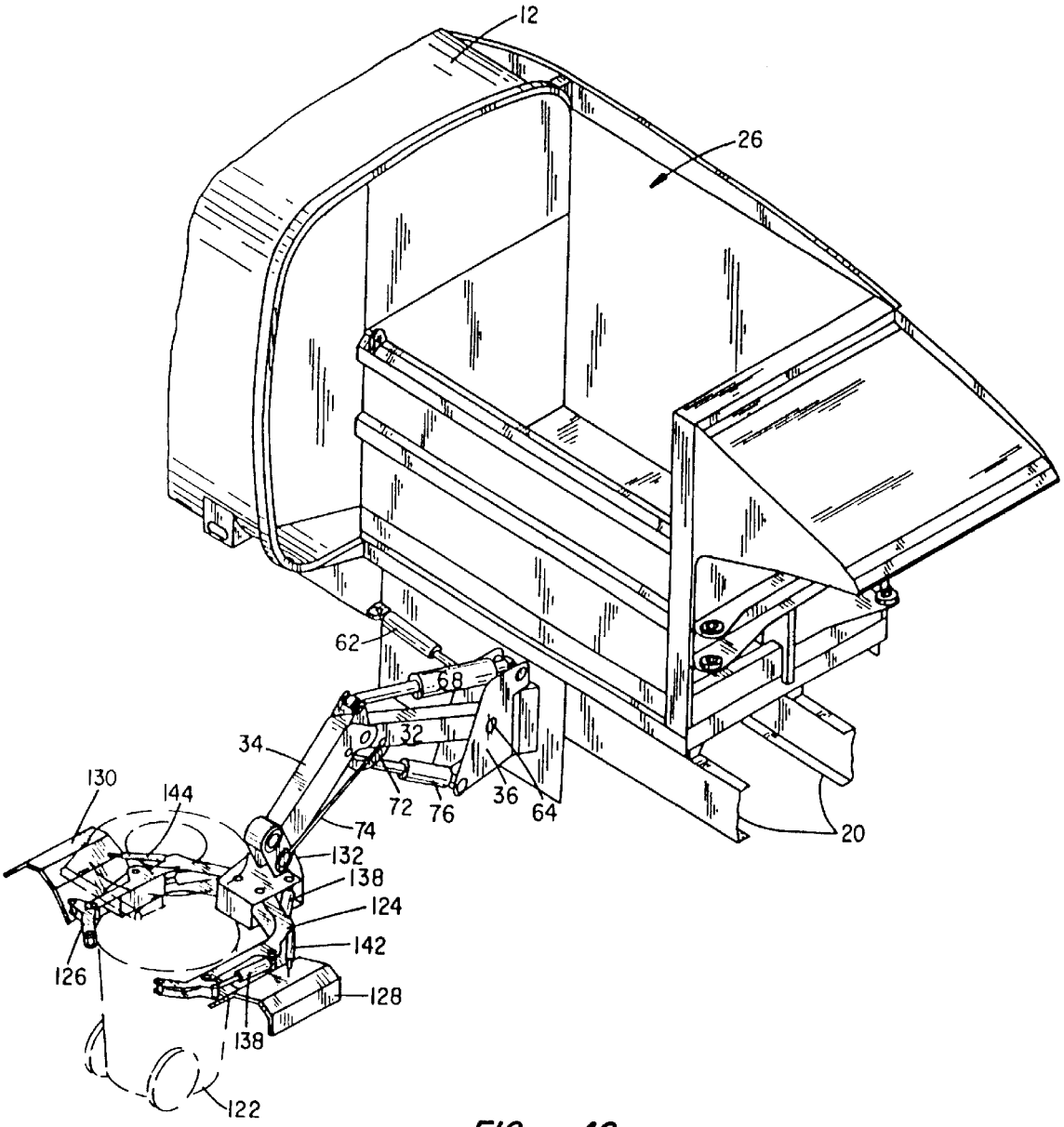
FIG. 42 is a fragmentary perspective view of the loading device of FIG. 33, shown in an extended position, wherein the articulated arms are shown grabbing the rigid container, and the scoops are shown in their non-actuated position.
Figure 43:
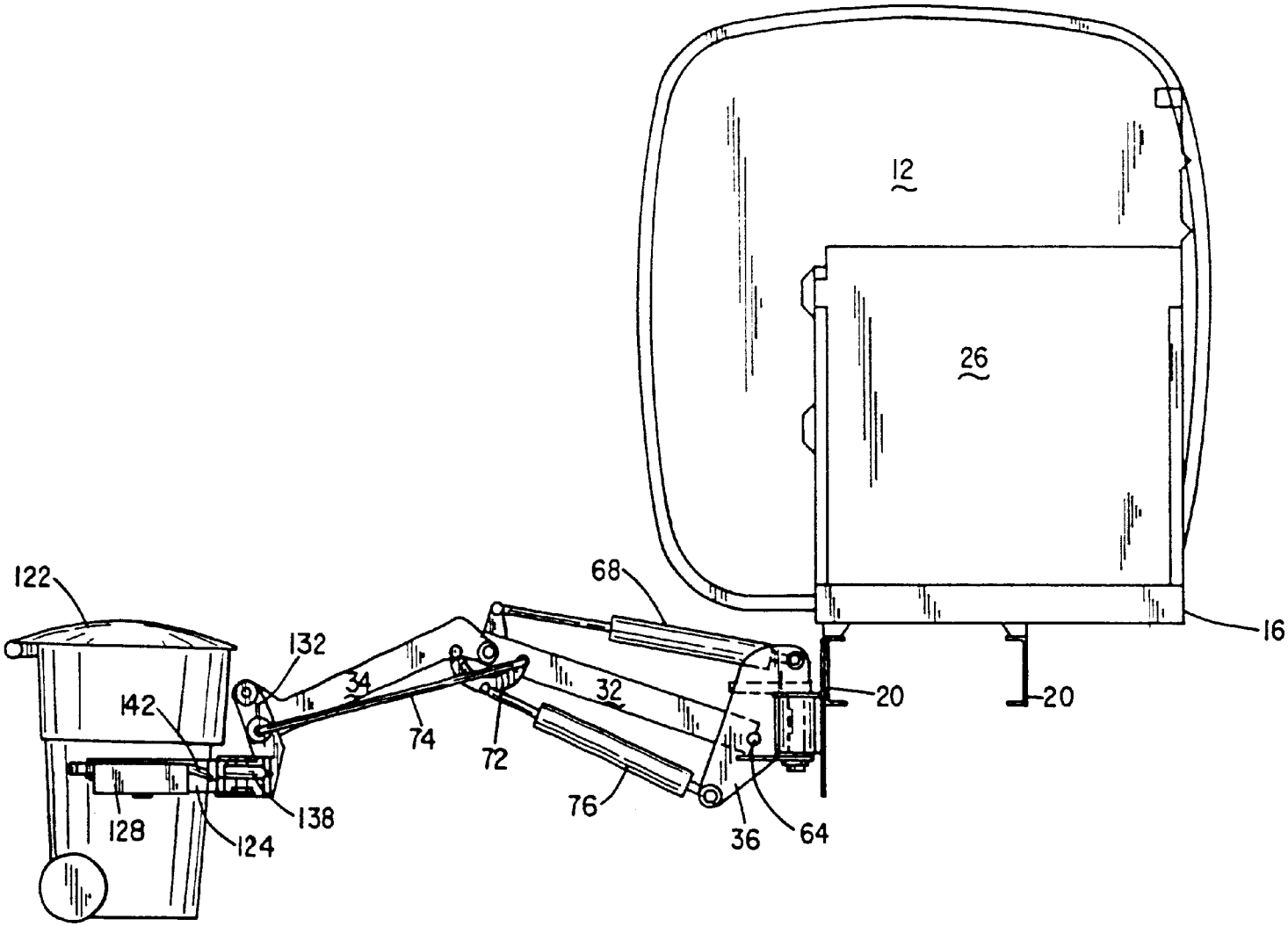
FIG. 43 is a front elevational view, partially in section, of the loading device and mechanized arm in their extended and actuated position as shown in FIG. 42.
Figure 44:
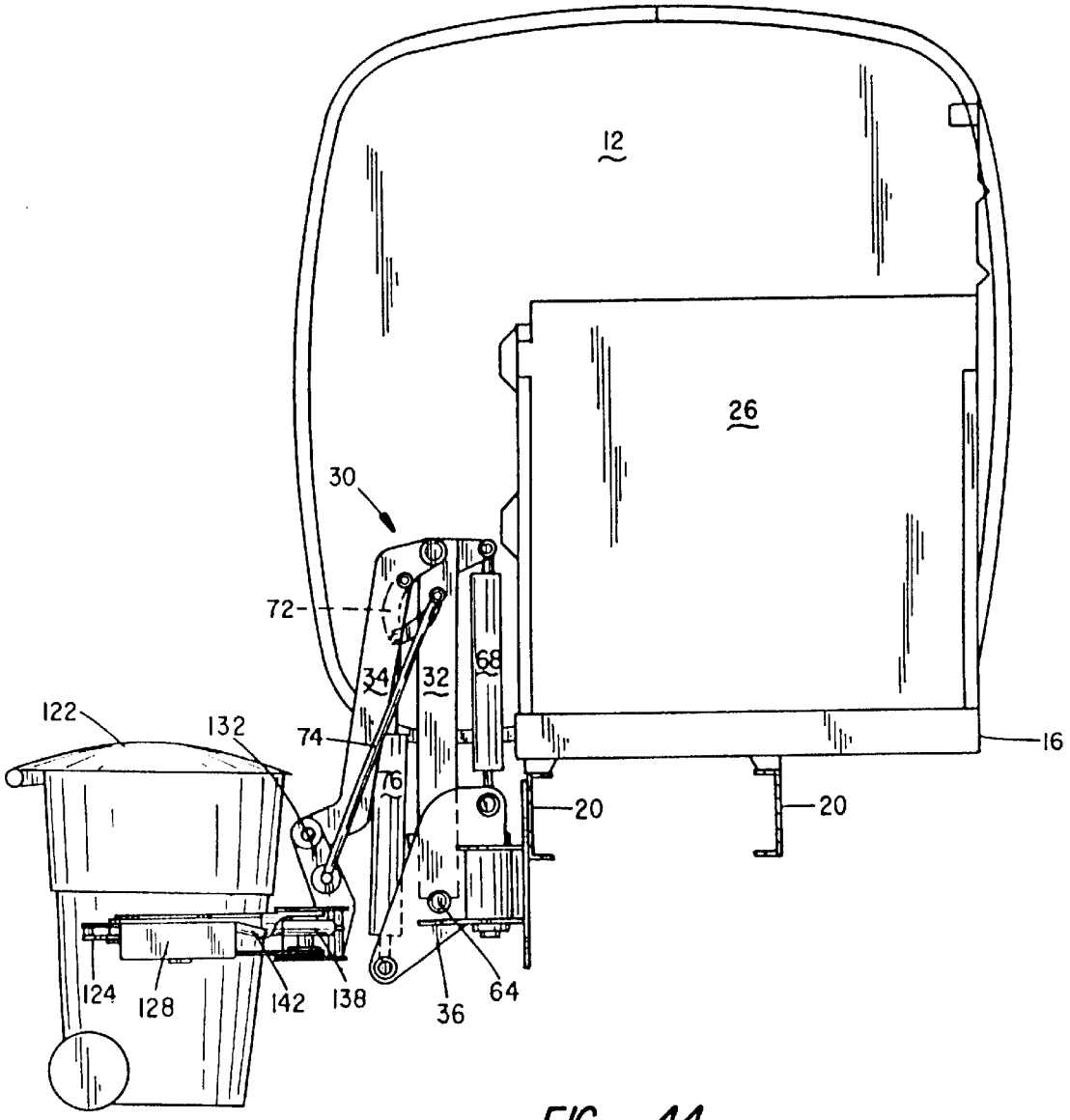
FIG. 44 is a front elevational view, partially in section, of the loading device of FIG. 33, shown in its stowed position, wherein the articulated arms are shown grabbing the rigid container.
Figure 45:
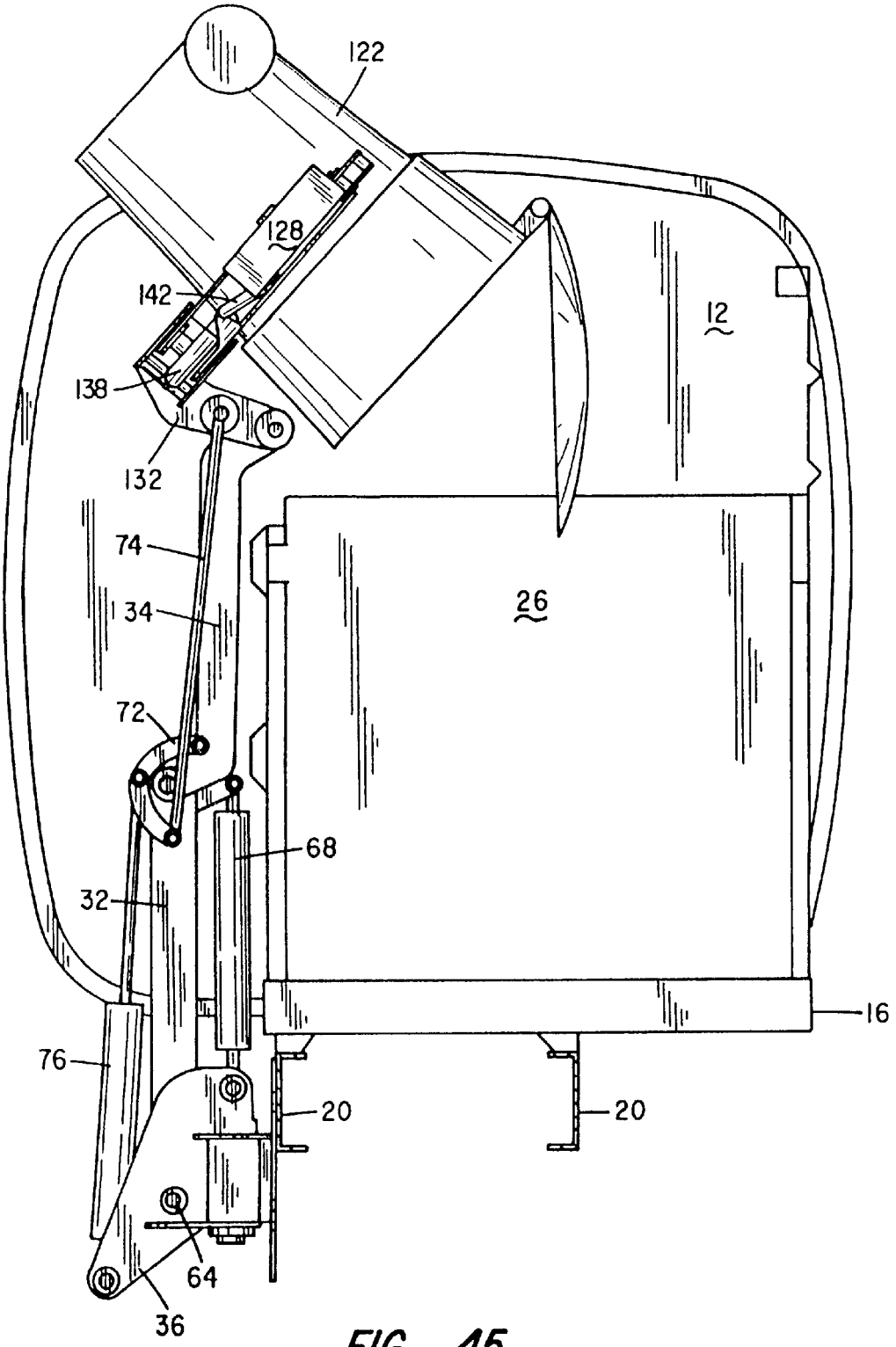
FIG. 45 is a front elevational view, partially in section, of the loading device and mechanized arm of FIG. 33 in a dumping position, with a rigid container captured within the grabber.

FIG. 40 shows lift and reach members 32 and 34 in their stowed position and aligned with a rigid container 122. FIG. 41 shows lift and reach members 32 and 34 in their extended position. FIGS. 42 and 43 shows lift and reach members 32 and 34 in their extended position and grabber arms 124 and 126 articulated closed and grabbing a rigid container, while scoops 128 and 130 remain in their open position. FIG. 44 shows lift and reach members 32 and 34 being retracted back towards refuse body 12, while articulated arms 124 and 126 continue to grasp rigid container 122. FIG. 45 shows lift and reach members 32 and 34 in their dumping positions, wherein rigid container 122 is inverted, causing the container's lid to rotate open, allowing the contents within container 122 to completely dump out of container 122.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A dual function apparatus for acquiring and transferring material to a receiving hopper of a collection vehicle, the apparatus comprising:

a) an articulated mechanized arm connected to a collection vehicle, operable between stowed, extended, lifting and dumping positions and having a free end;

b) a container grabbing mechanism comprising a pair of opposed arms connected to said free end of said mechanized arm and aligned in spaced relation operable for accessing, grasping and releasing a container of interest and a fluid-operated arm actuating system connected to said pair of arms for opening and closing said opposed arms; and (c) a pair of opposed mechanized scoops carried by and pivotally connected to said free end of said mechanized arms and disposed to converge and diverge beneath a soft-sided container of interest and provide support in a plane generally parallel to that described by said opposed arms of said grabbing mechanism and a fluid-operated scoop actuating system connected between said free end of said mechanized arm and said opposed mechanized scoops for opening and closing said scoops.

2. The apparatus of claim 1, wherein said arm actuating system and said scoop actuating system are operable separately or in concert.

3. The apparatus of claim 2, wherein said grabbing mechanism and said opposed mechanism scoops operate in parallel, generally horizontal planes when accessing a container to be emptied.

4. The apparatus of claim 2 wherein said opposed scoops are open at the top and designed to close beneath and support the bottom of a soft-sided container to be emptied.

5. The apparatus of claim 1, wherein said arm actuating system and said scoop actuating system comprise double-acting hydraulic cylinders.

6. The apparatus of claim 1, wherein said grabbing mechanism and said opposed mechanized scoops operate in parallel, generally horizontal planes when accessing a container to be emptied.

7. The apparatus of claim 6 wherein said opposed scoops are open at the top and designed to close beneath and support the bottom of a soft-sided container to be emptied.

8. The apparatus of claim 1 further comprising a deflection shield for deflecting the material being emptied by said apparatus connected to the free end of said articulated mechanized arm.

9. The apparatus of claim 1 wherein said opposed scoops are open at the top and designed to close beneath and support the bottom of a soft-sided container to be emptied.

10. The apparatus of claim 1 wherein said opposed arms of said grabbing mechanism and said opposed mechanized scoops are connected to the free end of said articulated arm by a common support member.

11. The apparatus of claim 1 wherein said articulated mechanized arm is swivel mounted.

12. The apparatus of claim 1 wherein said container of interest is a soft container itself designed to be discarded.

* * * * *